US009523248B2

(12) United States Patent
Thibodeaux, Jr. et al.

(10) Patent No.: US 9,523,248 B2
(45) **Date of Patent: *Dec. 20, 2016**

(54) APPARATUS AND METHOD TO SUPPORT A TUBULAR MEMBER

(71) Applicant: Frank's Casing Crew and Rental Tools, Inc., Lafayette, LA (US)

(72) Inventors: Robert Thibodeaux, Jr., Lafayette, LA (US); Jeremy Richard Angelle, Lafayette, LA (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 269 days.

This patent is subject to a terminal disclaimer.

(21) Appl. No.: 14/269,733

(22) Filed: May 5, 2014

(65) Prior Publication Data

US 2015/0000934 A1 Jan. 1, 2015

Related U.S. Application Data

(63) Continuation of application No. 12/970,716, filed on Dec. 16, 2010, now Pat. No. 8,720,589.

(60) Provisional application No. 61/287,659, filed on Dec. 17, 2009.

(51) Int. Cl.
*E21B 19/10* (2006.01)
*E21B 19/07* (2006.01)

(52) U.S. Cl.
CPC ..... *E21B 19/10* (2013.01); *E21B 19/07* (2013.01); *Y10T 29/49826* (2015.01)

(58) Field of Classification Search
CPC ..... E21B 19/07; E21B 19/10; E21B 3/04
See application file for complete search history.

(56) References Cited

U.S. PATENT DOCUMENTS 1,601,369 A * 9/1926 Montgomery ..... E21B 19/07 175/423
1,849,102 A 3/1932 Livergood
1,889,592 A 11/1932 Fokko
2,410,589 A * 11/1946 Segelhorst ..... E21B 19/10 166/75.14

(Continued)

OTHER PUBLICATIONS

Extended European Search Report in corresponding European Application No. 10842647.9 dated Feb. 19, 2015 (6 pages).

(Continued)

*Primary Examiner* — Cathleen Hutchins
(74) *Attorney, Agent, or Firm* — Osha Liang LLP

(57) ABSTRACT

Apparatuses and methods are disclosed herein relating to an apparatus to support a tubular member. The apparatus includes a bowl having a longitudinal axis extending therethrough, in which the bowl includes an inner wall formed about the longitudinal axis that is tapered with respect to the longitudinal axis. The apparatus further includes a plurality of slip assemblies movably disposed within to the bowl and having a tapered outer surface and a tapered inner surface with respect to the longitudinal axis. The tapered outer surface of the plurality of slip assemblies is configured to engage the tapered inner wall of the bowl. Further, the bowl may include a shoulder disposed on the inner wall that extends towards the longitudinal axis with respect to the inner wall. Each of the plurality of slip assemblies may be configured to engage the shoulder of the bowl.

34 Claims, 16 Drawing Sheets

(56) References Cited

U.S. PATENT DOCUMENTS

| | | | |
|---|---|---|---|
| 5,297,833 | A | 3/1994 | Willis et al. |
| 2006/0225891 | A1 | 10/2006 | Adams et al. |
| 2009/0056930 | A1 | 3/2009 | Angelle et al. |

OTHER PUBLICATIONS

Extended European Search Report issued in corresponding European Application No. 16171473.8 dated Sep. 20, 2016 (5 pages).

* cited by examiner

APPARATUS AND METHOD TO SUPPORT A TUBULAR MEMBER

CROSS-REFERENCE TO RELATED APPLICATIONS

The present application is a continuation of, and therefore claims benefit under 35 U.S.C. §120 to, U.S. patent application Ser. No. 12/970,716, filed on Dec. 16, 2010. Further, the present application claims benefit under 35 U.S.C. §119 to, U.S. Provisional Application No. 61/287,659, filed on Dec. 17, 2009. The disclosure of this U.S. Provisional application is incorporated herein by reference in its entirety.

BACKGROUND OF DISCLOSURE

Field of the Disclosure

Embodiments disclosed herein generally relate to methods and apparatuses to support tubular members. More specifically, embodiments disclosed herein relate to apparatuses that are used to support one or more tubular members, such as oilfield tubular members as the tubular members are disposed downhole.

Background Art

In oilfield exploration and production operations, various oilfield tubular members are used to perform important tasks, including, but not limited to, drilling the wellbore and casing a drilled wellbore. For example, a long assembly of drill pipes, known in the industry as a drill string, may be used to rotate a drill bit at a distal end to create the wellbore. Furthermore, after a wellbore has been created, a casing string may be disposed downhole into the wellbore and cemented in place to stabilize, reinforce, or isolate (among other functions) portions of the wellbore. As such, strings of drill pipe and casing may be connected together, such as end-to-end by threaded connections, in which a female "pin" member of a first tubular member is configured to threadably engage a corresponding male "box" member of a second tubular member. Alternatively, a casing string may be made-up of a series of male-male ended casing joints coupled together by female-female couplers. The process by which the threaded connections are assembled is called "making-up" a threaded connection, and the process by which the connections are disassembled is referred to "breaking-out" the threaded connection. As would be understood by one having ordinary skill, individual pieces (or "joints") of oilfield tubular members may come in a variety of weights, diameters, configurations, and lengths.

Referring to FIGS. 1A and 1B, multiple perspective views are shown of a drilling rig 101 used to run one or more tubular members 111 (e.g., casing, drill pipe, etc.) downhole into a wellbore. As shown, the drilling rig 101 includes a frame structure known as a "derrick" 102, from which a traveling block 103 and a lifting apparatus 105 (e.g., an elevator), a supporting apparatus 107 (e.g., slip assembly or spider), and/or a top drive 145, if present (shown in FIG. 1B), may be used to manipulate (e.g., raise, lower, rotate, hold, etc.) a tubular member 111. The traveling block 103 is a device that is suspended from at or near the top of the derrick 102, in which the traveling block 103 may move up-and-down (i.e., vertically as depicted) to raise and/or lower the tubular member 111. The traveling block 103 may be a simple "pulley-style" block and may have a hook from which objects below (e.g., lifting apparatus 105 and/or top drive) may be suspended.

Additionally, the lifting apparatus 105 may be coupled below the traveling block 103 and/or the top drive 145 to selectively support and/or release a tubular member 111 as the tubular member 111 is to be raised and/or lowered within and from the derrick 102. As such, and as shown in FIG. 1B, the drilling rig 101 may include one or more guiding rails 108 and/or a track disposed adjacent to the top drive 145, in which the guiding rails 108 or track may be used to support and guide the top drive 145 (e.g., from which the lifting apparatus 105 may be suspended) as the top drive 145 is raised and/or lowered within the derrick 102. An example of a top drive is disclosed within U.S. Pat. No. 4,449,596, filed on Aug. 3, 1982, and entitled "Drilling of Wells with Top Drive Unit," which is incorporated herein by reference in its entirety.

The lifting apparatus 105 may include one or more movable engagement members (e.g., slip assemblies), in which the members may be attached to the lifting apparatus 105 and movable between an open position and a closed position. In the closed position, the lifting apparatus 105 supports the tubular member 111 such that the tubular member 111 may be lifted and/or lowered. In the open position, the lifting apparatus 105 may release the tubular member 111 and move away therefrom to allow the tubular member 111 to be engaged with or removed from the lifting apparatus 105 and/or the supporting apparatus 107. For example, the lifting apparatus 105 may release the tubular member 111 after the tubular member 111 is threadably connected to a tubular string 115 and/or supported by the supporting apparatus 107 of the drilling rig 101.

Further, in FIG. 1B, in which the drilling rig 101 includes a top drive 145 having link (e.g., bail) ears supporting lifting apparatus 105 (e.g., an elevator) through links (e.g., bails) therebetween. The supporting apparatus 107 of the drilling rig 101 may be used to support the tubular string 115, such as by having gripping and/or supporting engagement with the tubular string 115, from the drilling rig 101, e.g., supported by the rig floor 109 or by a rotary table thereof. The supporting apparatus 107 may be disposed within (e.g., be supported by) the rig floor 109, such as flush with the rig floor 109, may extend (e.g., be supported by) above the rig floor 109, as shown, and/or may be supported otherwise by the drilling rig, such as suspended from a component of the drilling rig. As such, the supporting apparatus 107 may be used to suspend the tubular string 115, e.g., while one or more tubular members 111 are connected or disconnected from the tubular string 115.

A reverse process, or one similar to the process described above, may be used, such as to remove one or more tubular members 111 from the drilling rig 101. As such, when removing a tubular member 111 from the drilling rig 101, the tubular string 115 may be raised into the derrick 102 to have the tubular member 111 extending above the supporting apparatus 107 and rotary table 109. The supporting apparatus 107 may be used to support the remainder of the downhole string 115 below the rotary table 109, in which the tubular member 111 may be threadably disconnected from the downhole string 115. For example, the supporting apparatus 107 may support the tubular member 111 and the top drive 145, and/or another other component, such as tubular tongs, may rotate the tubular member 111 to threadably disconnect the tubular member 111 from the downhole string 115. The lifting apparatus 105, or other mechanism or device, may transport the tubular member 111 out of the derrick 102 of the drilling rig 101, e.g., to have the tubular member 111 placed upon the pipe rack 112.

As such, a string of tubular members may be heavy, in the magnitude of several hundreds of thousands of pounds. The lifting and supporting apparatuses handling these tubular strings, in addition to the drilling rig and other components thereof, must be equipped to handle such weight. Accordingly, there may exist a need to increase the ability of one or more components of the drilling rig, particularly the lifting and supporting apparatus, to safely and securely lift and support tubular members.

SUMMARY OF DISCLOSURE

In one aspect, embodiments disclosed herein relate to an apparatus to support a tubular member. The apparatus includes a bowl having a longitudinal axis extending therethrough, in which the bowl includes a first opening formed at a top side of the bowl, a second opening formed at a bottom side of the bowl, and an inner wall extending from the first opening to the second opening about the longitudinal axis, in which the inner wall is tapered with respect to the longitudinal axis. The apparatus further includes a plurality of slip assemblies movably disposed within to the bowl and having a tapered outer surface and a tapered inner surface with respect to the longitudinal axis. The tapered outer surface of the plurality of slip assemblies is configured to engage the tapered inner wall of the bowl, and an angle of the tapered inner surface of the plurality of slip assemblies with respect to the longitudinal axis is larger than an angle of the tapered inner wall of the bowl with respect to the longitudinal axis.

In another aspect, embodiments disclosed herein relate to an apparatus to support a tubular member. The apparatus includes a bowl having a longitudinal axis extending therethrough, in which the bowl includes a first opening formed at a top side of the bowl, a second opening formed at a bottom side of the bowl, an inner wall extending from the first opening to the second opening about the longitudinal axis, and a shoulder disposed on the inner wall that extends towards the longitudinal axis with respect to the inner wall. A plurality of slip assemblies is movably disposed within the bowl and having a tapered inner surface with respect to the longitudinal axis. Each of the plurality of slip assemblies is configured to engage the shoulder of the bowl.

In another aspect, embodiments disclosed herein relate to a method to manufacture an apparatus to support a tubular member. The method includes providing a bowl having an inner wall formed therein and extending therethrough, in which the bowl and the inner wall are defined about a longitudinal axis, and the inner wall is tapered with respect to the longitudinal axis, and movably coupling a plurality of slip assemblies to the bowl, in which the plurality of slip assemblies has a tapered outer surface and a tapered inner surface with respect to the longitudinal axis. An angle of the tapered inner surface of the plurality of slip assemblies with respect to the longitudinal axis is larger than an angle of the tapered inner wall of the bowl with respect to the longitudinal axis.

In another aspect, embodiments disclosed herein relate to a method to manufacture an apparatus to support a tubular member. The method includes providing a bowl having an inner wall formed therein and extending therethrough, in which the bowl and the inner wall are defined about a longitudinal axis, and a shoulder is disposed on the inner wall that extends towards the longitudinal axis with respect to the inner wall, and movably coupling a plurality of slip assemblies to the bowl, in which the plurality of slip assemblies has a tapered inner surface with respect to the longitudinal axis. Each of the plurality of slip assemblies is configured to engage the shoulder of the bowl.

In another aspect, embodiments disclosed herein relate to a method to support a tubular member. The method includes providing a bowl having an inner wall extending therethrough and a plurality of slip assemblies movably connected thereto, in which the bowl and the inner wall are defined about a longitudinal axis, disposing the tubular member within the bore of the bowl, engaging an outer tapered surface of the tubular member with an inner surface of the plurality of slip assemblies, in which the inner surface of the plurality of slip assemblies is tapered with respect to the longitudinal axis, and engaging an outer surface of the plurality of slip assemblies with the inner wall of the bowl, in which the outer surface of the plurality of slip assemblies and the inner wall are tapered with respect to the longitudinal axis. An angle of the tapered inner surface of the plurality of slip assemblies with respect to the longitudinal axis is larger than an angle of the tapered inner wall of the bowl with respect to the longitudinal axis.

In another aspect, embodiments disclosed herein relate to a method to support a tubular member. The method includes providing a bowl having an inner wall extending therethrough and a plurality of slip assemblies movably connected thereto, in which the bowl and the inner wall are defined about a longitudinal axis, disposing the tubular member within the bore of the bowl, engaging an outer tapered surface of the tubular member with an inner surface of the plurality of slip assemblies, in which the inner surface of the plurality of slip assemblies is tapered with respect to the longitudinal axis, and engaging the plurality of slip assemblies with a shoulder disposed on the inner wall of the bowl, in which the shoulder extends towards the longitudinal axis with respect to the inner wall.

Other aspects and advantages of the invention will be apparent from the following description and the appended claims.

DETAILED DESCRIPTION

Figure 1A:
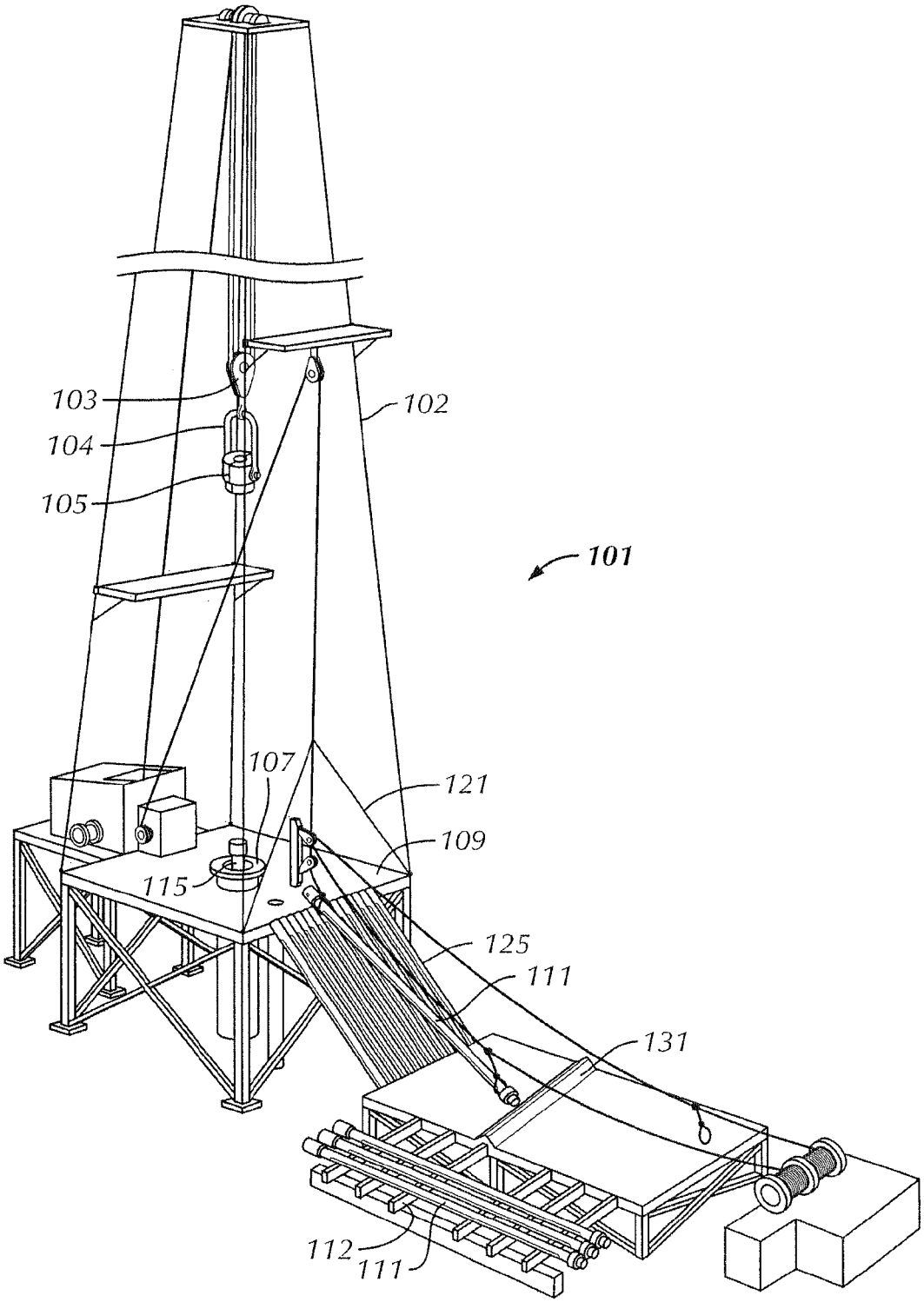
FIGS. 1A and 1B show multiple perspective views of drilling rigs.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description.

Furthermore, as used herein, the terms "above" and "below;" "up" and "down;" "upper" and "lower;" "upwardly" and "downwardly;" and other like terms indicating relative positions above or below a given point or element are used in this description to more clearly describe some embodiments. However, those having ordinary skill in the art will appreciate that when applied to equipment and methods that deviate from the referenced Figures, such as when horizontal, such terms may refer to a left-to-right, right-to-left, or diagonal relationship as appropriate.

Accordingly, in various aspects disclosed herein, embodiments disclosed herein generally relate to an apparatus that may be used to support a tubular member, such as engaging and supporting a tubular member when assembling and/or disassembling a string of tubular members. For example, embodiments disclosed herein generally relate to an apparatus that may support a tubular member, in which the apparatus may suspend the tubular member and/or move the tubular member within a drilling rig, as desired. As such, the apparatus may be used to raise, lower, and/or otherwise move the tubular member within the drilling rig, such as may be necessary to assemble and/or disassemble a string of tubular members. In one or more embodiments, the apparatus may be what is conventionally referred to in oilfield terminology as an elevator, in which the elevator may be used in combination with one or more devices and/or tools, such as a supporting apparatus (e.g., a spider) and/or a top drive within a drilling rig. In such embodiments, the apparatus may be used to selectively engage, support, and/or move one or more tubular members, such as in combination with the other devices and/or tools, thereby enabling the tubular members to be manipulated, as desired. As such, in one or more embodiments, the apparatus of the present disclosure may be used with a drilling rig, such as a lifting apparatus (e.g., elevator), a supporting apparatus (e.g., spider), and/or as any other components used with a drilling rig.

Thus, in one aspect, an apparatus in accordance with embodiments disclosed herein may include a bowl and a plurality of slip assemblies movably disposed within the bowl, such as connected to the bowl. The bowl may have a bore or an opening formed therein with a longitudinal axis extending therethrough. As such, an inner wall may be fainted that extends through the bowl. For example, the bowl may have a first opening formed at the top side of the bowl and a second opening formed at a bottom side of the bowl. An inner wall may extend through the bowl from the first opening to the second opening about the longitudinal axis of the bowl. Further, the inner wall may be tapered, or at least a portion thereof may be tapered, with respect to the longitudinal axis.

As mentioned, a plurality of slip assemblies may be movably disposed within the bowl, such as connected to the bowl. The slip assemblies may be able to move in a longitudinal direction along the longitudinal axis with respect to the bowl, and the slip assemblies may be able to move in a radial direction of the longitudinal axis with respect to the bowl. As such, the slip assemblies may be moved into and/or out of engagement with a tubular member, such as when a tubular member is disposed within the bowl of the apparatus.

Further, the plurality of slip assemblies may each have an outer surface and an inner surface, in which the outer surface and/or the inner surface may be tapered with respect to the longitudinal axis. In such embodiments, the tapered inner surface of each of the plurality of slip assemblies may be used to engage a tubular member (e.g., an outward shoulder thereof), and/or the tapered outer surface of each of the plurality of slip assemblies may be configured to engage the tapered inner wall of the bowl. For example, in an embodiment in which each of the plurality of slip assemblies is movable with respect to the bowl, each of the plurality of slip assemblies may be able to move into and/or out of engagement with a tubular member disposed within the bowl and/or the inner wall of the bowl. As such, in accordance with one or more embodiments disclosed herein, an angle of the tapered inner surface of one or more of the plurality of slip assemblies with respect to the longitudinal axis may be larger than an angle of the tapered inner wall of the bowl with respect to the longitudinal axis.

Furthermore, in accordance with one or more embodiments disclosed herein, the bowl may have a shoulder disposed on the inner wall of the bowl, such as by having the shoulder formed on the inner wall of the bowl. The shoulder may extend outward from the inner wall of the bowl, such as by having the shoulder extend towards the longitudinal axis of the bowl with respect to the inner wall. In such embodiments, one or more of the plurality of slip assemblies may be able to engage the shoulder of the bowl. For example, in an embodiment in which each of the plurality of slip assemblies is movable with respect to the bowl, each of the plurality of slip assemblies may be able to move into and/or out of engagement with the shoulder of the bowl. As such, the shoulder of the bowl may be used to support the slip assemblies, such as when the slip assemblies may be engaging a tubular member.

As used herein, "connected" may refer to not only having two or more elements directly attached to each other, but connected may additionally refer to having two or more elements indirectly attached to each other. For example, as discussed more below, an apparatus in accordance with embodiments disclosed herein may have a slip assembly connected to a bowl of the apparatus. As such, it should be understood that the present disclosure contemplates not only having the slip assembly directly attached to the bowl, but the present disclosure additionally contemplates other structures and/or arrangements for the apparatus, such as by having a structure or member disposed between the slip assembly and the bowl, in which the slip assembly and the bowl are connected to each other through the other structure or member. Accordingly, those having ordinary skill in the art will appreciate that the present disclosure contemplates structures and arrangements other than those disclosed but still in accordance with one or more embodiments disclosed herein.

Figure 2A:
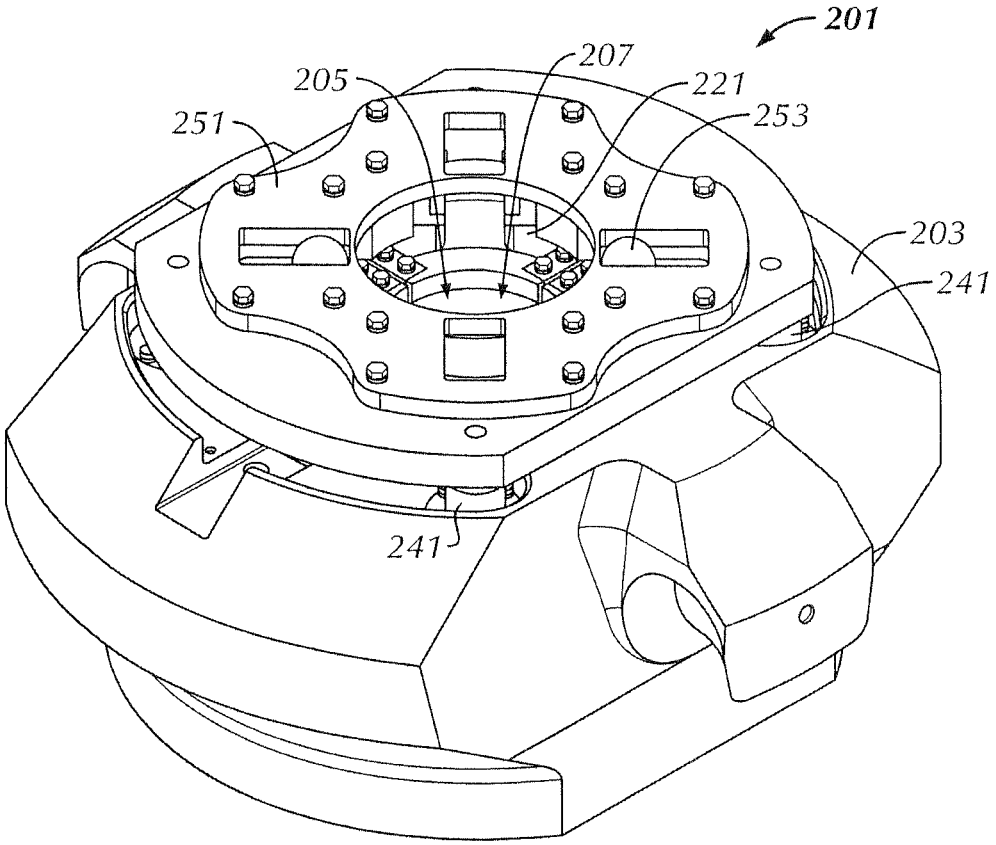
FIGS. 2A and 2B show multiple view of an apparatus to support a tubular member in accordance with one or more embodiments disclosed herein
Figure 2B:
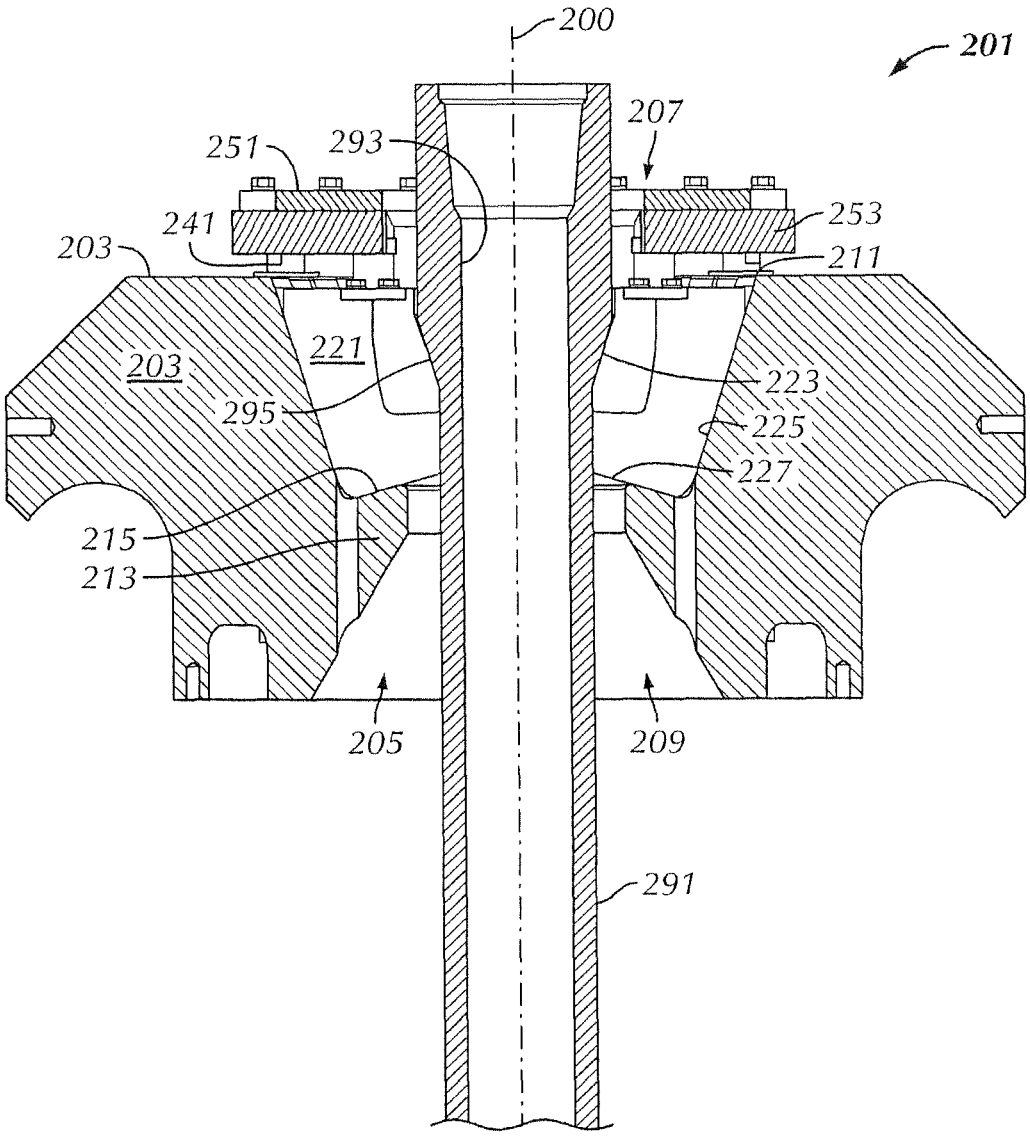

Referring now to FIGS. 2A and 2B, multiple views of an apparatus 201 to support a tubular member 291 in accordance with one or more embodiments disclosed herein is shown. Particularly, FIG. 2A shows a perspective view of the apparatus 201 in accordance with one or more embodiments disclosed herein is shown, and FIG. 2B shows a cross-sectional view of the apparatus 201 engaging and supporting a tubular member 291 in accordance with one or more embodiments disclosed herein is shown.

Figure 1B:
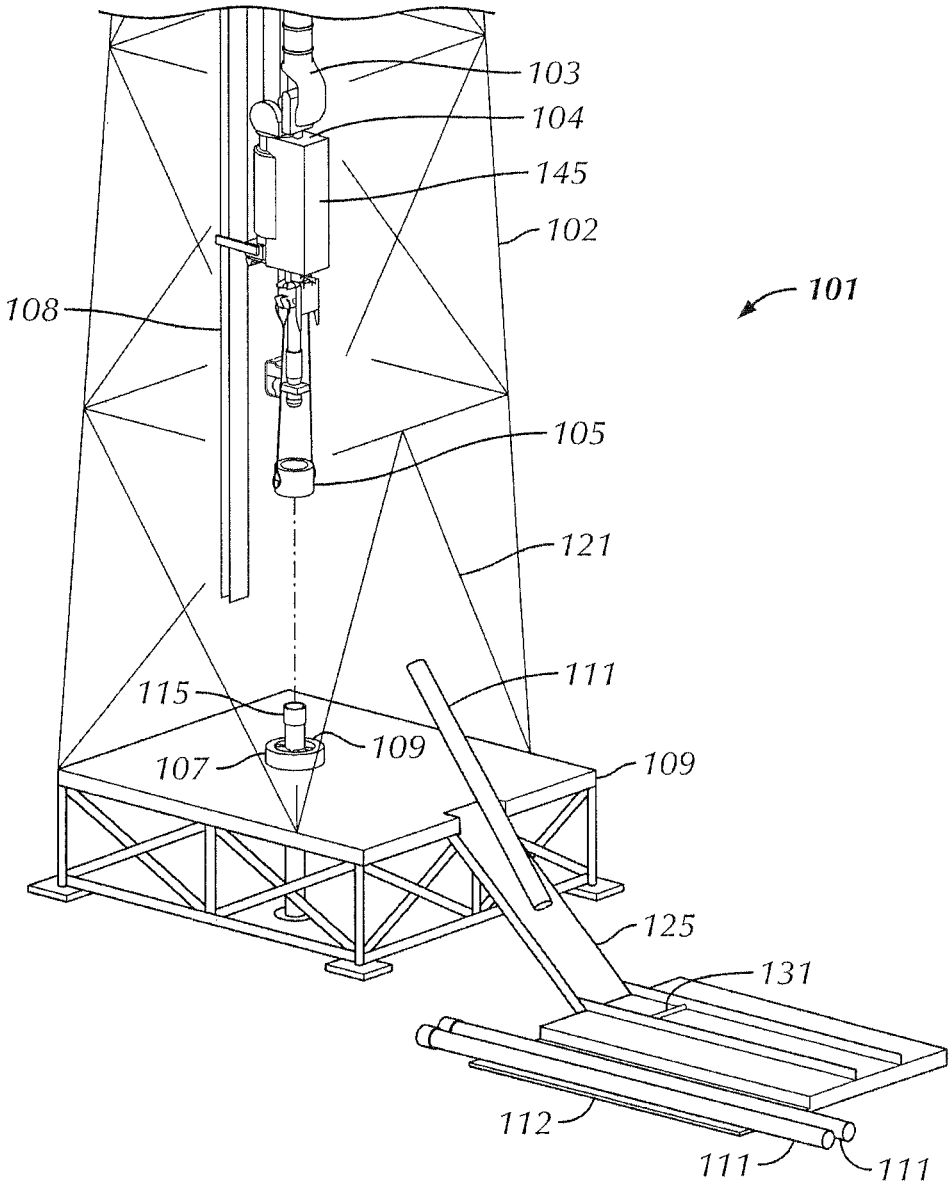

The illustrated apparatus 201, which may be a lifting apparatus (e.g., 105 in FIGS. 1A and 1B), such as an elevator, a supporting apparatus (e.g., 107 in FIGS. 1A and 1B), and/or any other device or mechanism used to support a tubular member, includes a bowl 203 defining a bore 205 therein. The bore 205 may be formed about an axis 200 extending (longitudinally) through the apparatus 201. Specifically, the bowl 203 may be formed such that a top opening 207 of the bore 205 is formed at a top side of the bowl 203, and a bottom opening of the bore 209 is formed at the bottom side of the bowl 203. Further, the illustrated bowl 203 has an inner wall 211 that extends between the top opening 207 of the bowl 203 to the bottom opening 209 and extends circumferentially around the bore. Although shown as a one piece bowl 203, bowl, etc. may be formed of multiple pieces.

The inner wall 211 of the bowl 203 may be tapered with respect to the axis 200, such as by having the inner wall skewed at an angle with respect to the axis 200. For example, the bowl 203 may have a smooth, non-stepped profile, tapered inner wall 211, or at least a portion of the inner wall 211 of the bowl 203 may have a smooth, non-stepped, tapered profile. As such, the bowl 203 may be used to enable the apparatus 201 to engage a range of tubular members having different dimensions (e.g., different outer diameters) and/or to engage with one or more slip assemblies 221 (discussed below) moving along the bowl 203. However, those having ordinary skill in the art will appreciate that the present disclosure is not so limited, as other shapes and profiles, such as a stepped (e.g., rapid advance) profile, may be used for the inner wall of the bowl without departing from the scope of the present disclosure.

Further, in addition to the bowl 203 having an inner wall 211, of which a portion may be a tapered surface, the bowl 203 may include a shoulder 213 (e.g., support shoulder). The shoulder 213 may be disposed on the inner wall 211 of the bowl 203, such as particularly having the shoulder 213 formed on the inner wall 211 of the bowl 203. As such, the shoulder 213 may extend outward from the inner wall 211 towards the axis 200. The shoulder 213 may allow the apparatus 201 to engage and thus support the slip assemblies 221 and provide additional support thereto, such as when the slip assemblies 221 move along the bowl 203 and/or when the slip assemblies 221 engage a tubular member.

The depicted apparatus 201 further includes a plurality of slip assemblies 221, in which the slip assemblies 221 may be movable with respect to the bowl 203 (e.g., in-and-out of the bowl 203), such as by having the slip assemblies 221 movably disposed within the bowl, such as connected to the bowl 203. Specifically, the slip assemblies 221 may be movable in a radial direction with respect to the bowl 203 (e.g., towards and/or away from the axis 200), and/or the slip assemblies 221 may be movable in a longitudinal direction with respect to the bowl 203 (e.g., along the axis 200). For example, by having the slip assemblies 221 movably connected to the bowl 203, the slip assemblies 221 may be able to "slide" towards and/or away from the axis 200, e.g., move along the inner wall of the bowl 203. As such, the slip assemblies 221 may engage a tubular member 291, such as engaging an outer surface of a tubular member received within the apparatus 201. Particularly, in one embodiment, the slip assemblies 221 may engage a shoulder of the tubular member 291. Further, the slip assemblies 221 may be restricted from lateral movement in the bore 205 (e.g., movement about the axis 200), for example, while still allowing for movement towards and/or away from axis 200 (e.g., radial movement relative to axis 200 of the bore 205).

The slip assemblies 221 may each have multiple surfaces defined thereon, such as by having an inner surface 223, an outer surface 225, and a lower surface 227. As shown, the inner surface 223 of the slip assemblies 221 is defined as a surface on the slip assemblies 221 that is exposed toward the axis 200, the outer surface 225 of the slip assemblies 221 is defined as a surface on the slip assemblies 221 that is exposed away from the axis 200 (e.g., toward the inner wall 211 of the bowl 203), and the lower surface 227 of the slip assemblies 221 is defined as a surface on the slip assemblies 221 that is exposed towards the bottom opening 209 of the bowl 203.

In accordance with one or more embodiments of the present disclosure, one or more of the surfaces of the slip assemblies 221 may be tapered with respect to the axis 200. For example, as shown in FIG. 2B, the inner surface 223, or at least a portion thereof, may be tapered with respect to the axis 200, and the outer surface 225, or at least a portion thereof, may be tapered with respect to the axis 200. In FIG. 2B, the tubular member 291 includes a shoulder portion 293, in which the shoulder portion 293 of the tubular member 291 has a larger outer diameter as compared to the remainder of the tubular member 291. As such, the tubular member 291 may have a tapered surface 295 adjacent to the tubular member 291 as a transition between the various diameters of the tubular member 291. Accordingly, in one or more embodiments, the tapered inner surface 223 of one or more of the slip assemblies 221 may be disposed at substantially the same angle as the tapered surface 295 of the tubular member 291.

Further, as shown, in addition to the inner surface 223 being tapered and/or having a tapered portion, the inner surface 223 may have additional portions disposed thereon. For example, as shown in FIG. 2B, additional surfaces are disposed adjacent to the tapered portion of the inner surface. As such, these portions may have substantially the same angle as the axis 200. However, those having ordinary skill in the art will appreciate that the present disclosure is not so limited, and other arrangements may be used for the inner surface 223, such as by having multiple tapered portions and/or multiple non-tapered portions.

Furthermore, in one or more embodiments, as shown in FIG. 2B, the tapered outer surface 225 of one or more of the slip assemblies 221 may be disposed at substantially the same angle as the tapered inner wall 211 of the bowl 203. In such embodiments, the tapered outer surface 225 of the slip assemblies 221 may be able to engage (e.g., slide along) the tapered inner wall 211 of the bowl 203. Furthermore, in one or more embodiments, the lower surface 227 of one or more of the slip assemblies 221 may be disposed at substantially the same angle as one or more of the surfaces of the bowl shoulder 213. For example, as shown in FIG. 2B, the shoulder 213 includes an upper surface 215, in which the upper surface 215 may be tapered with respect to the axis 200. In such embodiments, the lower surface 227 of the slip assemblies 221 may be disposed at substantially the same angle as the upper surface 215 of the shoulder 213, in which this arrangement may enable the shoulder 213 to support the slip assemblies 221, such as when the slip assemblies 221 are engaging and/or supporting the tubular member 291.

In one embodiment, the upper surface 215 of the shoulder 213 may be tapered with respect to the axis 200 at an angle between about 90 degrees and about 0 degrees (e.g., may be horizontal relative to the bowl 203 or angled, as is shown in the example in FIG. 2B). In such an embodiment, when the tubular member 291 (and any tubular member attached thereto) is supported by the slip assemblies 221, the slip assemblies 221 may be supported on (e.g., disposed against) the shoulder 213 and, thus, the weight of the tubular member 291 reacts against the bowl 203. By having the shoulder 213 extend at an angle between about 90 degrees and about 0 degrees (e.g., horizontal relative to the bowl 203 or angled, as is shown in the example in FIG. 2B), the force from the weight may not cause the slips to move inwardly (e.g., radially inwardly). This is in sharp contrast to a wedge grip (e.g., slip grip) type of gripping device in which that as more force (e.g., weight) is applied, the grips may be wedged further inwardly, which may lead to the tubular being crushed, damaged, etc. Further, the inner surface 223 and the outer surface 227 of the slip assemblies 221, in addition to the inner wall 211 of the bowl 203, may be used in conjunction with each other to support one or more tubular members. For example, in addition to the upper surface 215, one or more of the surfaces 223, 227, and 211 may also support some of the weight of the tubular member 291.

Referring still to FIGS. 2A and 2B, the apparatus 201 may further include an actuator, such as a plurality of actuator rods 241, and/or a support ring 251. In one or more embodiments, the support ring 251 may be a "timing ring", in which the timing ring may enable the apparatus 201 to have substantially similar control over the slip assemblies 221, such as when the slip assemblies 221 are moving in the longitudinal direction along the axis 200. Further, the actuator rods 241 may extend from the bowl 203, such as from the top side of the bowl 203, in which the actuator rods 241 may be substantially parallel with the axis 200. The support ring 251 may be attached to the actuator rods 241, in which the support ring 251 may be able to move in a longitudinal direction (i.e., vertically) along the axis 200. As such, in one embodiment, the support ring 251 may be attached to the top end of the actuator rods 241, in which the actuator rods 241 may be able to move in the longitudinal direction along the axis 200. The movement of the actuator rods 241 may enable the movement of the support ring 251.

In another embodiment, the support ring 251 may be able to slide along the actuator rods 241, in which the actuator rods 241 may stay relatively stationary with respect to the support ring 251. In such an embodiment, the actuator rods 241 may then guide the support ring 251 as the support ring 251 moves in the longitudinal direction along the axis 200. Further, in some embodiments, as the actuator rods 241 move in the longitudinal direction along the axis 200, the actuator rods 241 may extend into and out of one or more cavities (shown in FIGS. 4A and 4B) formed within the bowl 203. These cavities may be able to retain the actuator rods 241 within the bowl 203 after the actuator rods 241 have moved longitudinally downward along the axis 200. Furthermore, the support ring 251 may be powered hydraulically, pneumatically, and/or electrically. In selected embodiments, when using hydraulic power, fluids may be pumped into and/or out of the cavities to move the actuator rods 241 and the support ring 251 downward and/or upward.

Further, the slip assemblies 221 may be movably connected to the bowl 203 within the apparatus 201, such as by having the slip assemblies 221 movably connected to the support ring 251. For example as shown particularly in FIG. 2A, a slide mechanism 253 may be used to enable the slip assemblies 221 to be able to move in the radial direction with respect to the axis 200. Additionally or alternatively, the slip assemblies 221 may be able to move in the longitudinal direction along the axis 200, such as when the support ring 251 moves in the longitudinal direction through the use of the actuator rods 241. However, those having ordinary skill in the art will appreciate that other mechanisms or connections may be used to movably connect the slip assemblies to the support ring and/or the bowl. For example, in accordance with embodiments disclosed herein, a pin-and-link mechanism may be used to movably connect the slip assemblies to the support ring. As such, the present disclosure contemplates other structures and/or arrangements for the apparatus without departing from the scope of the present disclosure.

Figure 3A:
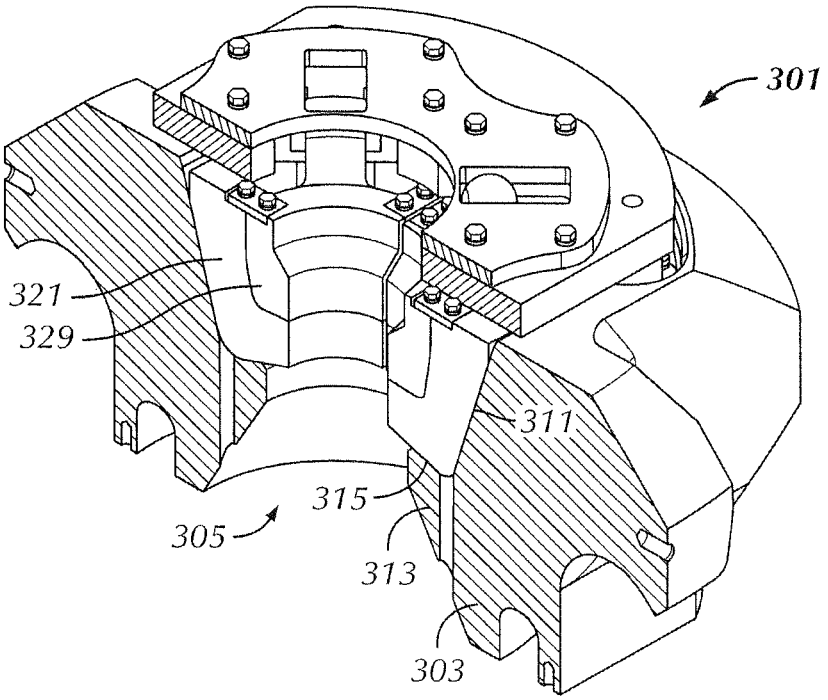
FIGS. 3A-3D show multiple views of an apparatus in accordance with one or more embodiments of the present disclosure.
Figure 3B:
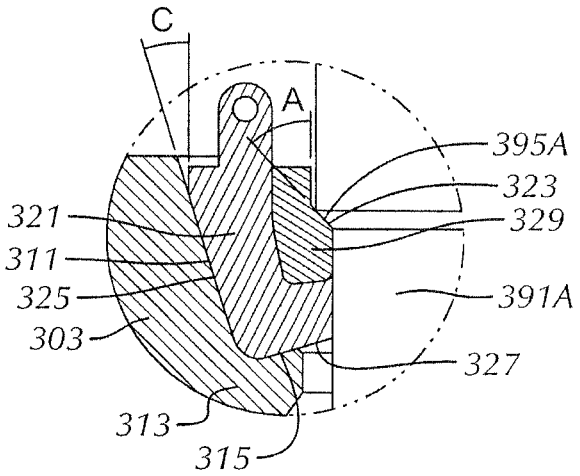
Figure 3C:
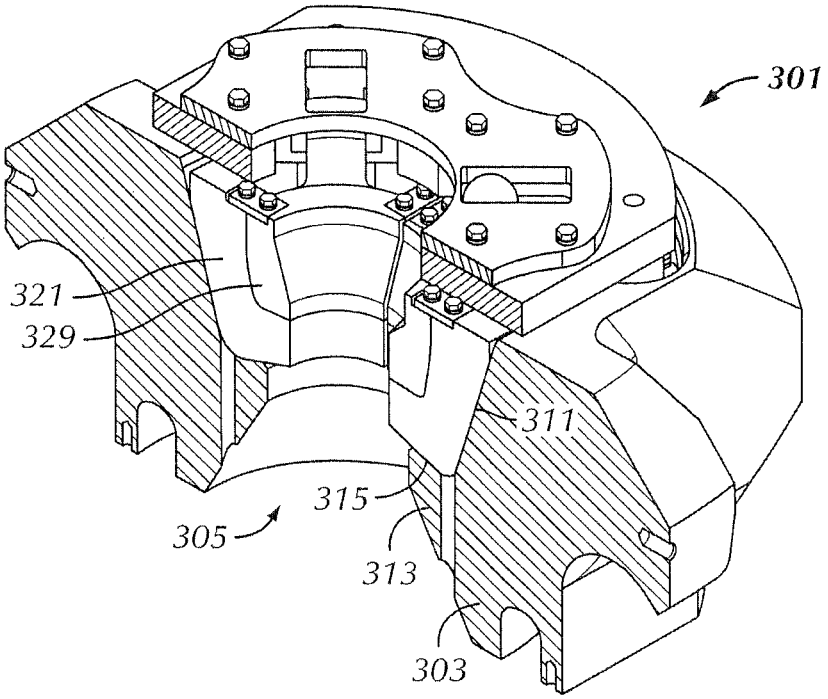
Figure 3D:
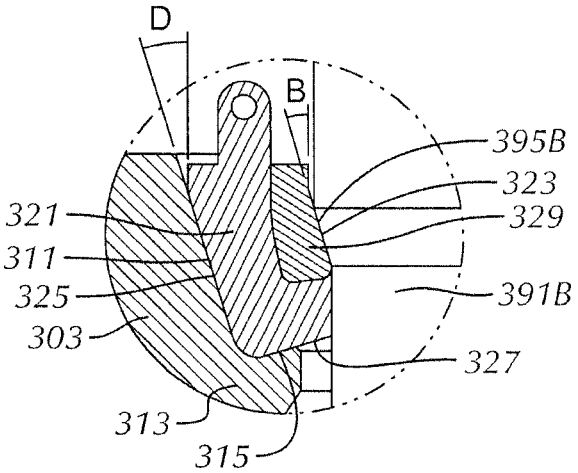

Referring now to FIGS. 3A-3D, multiple views of an apparatus 301 in accordance with one or more embodiments of the present disclosure are shown. Particularly, FIG. 3A shows a perspective cutaway view of the apparatus 301, and FIG. 3B shows a detail view of a portion of the apparatus 301 engaging a tubular member 391A. Similarly, FIG. 3C shows a perspective cutaway view of the apparatus 301, and FIG. 3D shows a detail view of a portion of the apparatus 301 engaging a tubular member 391B.

Similar to the above embodiment shown in FIGS. 2A and 2B, the apparatus 301 may include a bowl 303 having a bore 305 with an axis (shown as 200 in FIG. 2B) extending therethrough. The bowl 303 may have an inner wall 311, and may further include a shoulder 313 having an upper surface 315. Further, the apparatus 301 may include a plurality of slip assemblies 321 movably connected to the bowl 303. The slip assemblies 321 may each include an inner surface 323, an outer surface 325, and a lower surface 327.

As discussed above, one or more surfaces of the apparatus 301 may be tapered with respect to the axis of the bowl 303 and the apparatus 301. As such, and as shown in FIGS. 3A-3D, the inner surface 323, the outer surface 325, and the lower surface 327 of the slip assemblies 321 may be tapered with respect to the axis, the inner wall 311 of the bowl 303 may be tapered with respect to the axis, and/or the upper surface 315 of the shoulder 313 may be tapered with respect to the axis. However, those having ordinary skill in the art will appreciate that, though, multiple surfaces are shown as being tapered with respect to the axis, one or more of the surfaces may not be tapered with respect to the axis. For example, in one, the upper surface of the shoulder may not be tapered with respect to the axis, e.g., disposed in a plane perpendicular and/or parallel to the axis 200.

As shown particularly in FIGS. 3B and 3D, the tubular members 391A and 391B may have one or more tapered surfaces 395A and 395B. In FIG. 3B, the tubular member 391A has a tapered surface 395A (e.g., shoulder) disposed at an angle A with respect to the longitudinal axis, and in FIG. 3D, the tubular member 391B has a tapered surface 395B (e.g., shoulder) disposed at an angle B with respect to the longitudinal axis. As such, the inner surface 323 of the slip assemblies 321 may be tapered at angles substantially similar or identical to the angles (e.g., A and B) of the tubular members (e.g., 391A and 391B).

For example, in FIG. 3B, the inner surface 323 of the slip assembly 321 may include a shoulder section tapered at an angle substantially equal to the angle A of the tapered surface 395A (e.g., shoulder) of the tubular member 391A, such as tapered at an angle of about 45 degrees with respect to the longitudinal axis of the apparatus, and in FIG. 3D, the inner surface 323 of the slip assembly 321 may be tapered at an angle substantially equal to the angle B of the tapered surface 395B of the tubular member 391B, such as tapered at an angle of about 18 degrees with respect to the longitudinal axis of the apparatus. Such arrangements of the inner surfaces of the slip assemblies may enable the slip assemblies to support the tubular members when the tubular members are received within the apparatus. Those having ordinary skills in the art, though, will appreciate that the present disclosure is not so limited, and other arrangements and tapers may be used for the surfaces of the slip assemblies without departing from the scope of the present disclosure, such as by having the inner surface of the slip assembly have a taper angle of only greater than perpendicular with respect to the axis of the tubular member.

Further, in one or more embodiments, the angle of the tapered inner surface 323 of the slip assemblies 321 with respect to the longitudinal axis may be larger (i.e., greater) than the angle of the tapered inner wall 311 of the bowl 303 with respect to the longitudinal axis. In FIG. 3B, the tapered inner wall 311 of the bowl 303 is disposed at an angle C with respect to the longitudinal axis, and in FIG. 3D, the tapered inner wall 311 of the bowl 303 is disposed at an angle D with respect to the longitudinal axis. As such, the angle A of the tapered inner surface 323 of the slip assemblies 321 with respect to the longitudinal axis in FIG. 3B may be larger than the angle C of the tapered inner wall 311 of the bowl 303 with respect to the longitudinal axis. Further, the angle B of the tapered inner surface 323 of the slip assemblies 321 with respect to the longitudinal axis in FIG. 3D may be larger than the angle D of the tapered inner wall 311 of the bowl 303 with respect to the longitudinal axis.

In accordance with one or more embodiments of the present disclosure, the angles C and D of the tapered inner surfaces 323 of the slip assemblies 321 may be substantially the same, such as about 17 degrees. In such embodiments, the angles A and B of the tapered inner wall 311 of the bowl 303 may each be about 18 degrees and 45 degrees, respectively (as used above), in which the angles C and D of the tapered inner surfaces 323 of the slip assemblies 321 may be about 17 degrees. As such, though exemplary angles are shown for one or more tapered surfaces of the apparatus of the present disclosure, those having ordinary skill in the art will appreciate that other angles may be used for one or more tapered surfaces of the apparatus without departing from the scope of the present disclosure.

In an embodiment in which the angle of the tapered inner surface of the slip assemblies with respect to the longitudinal axis is larger than the angle of the tapered inner wall of the bowl with respect to the longitudinal axis, such an arrangement may establish a mechanical lock within the apparatus of the present disclosure, particularly between the slip assemblies and the bowl when the tubular is present. For example, in FIG. 3D, the angle of the tapered inner surface 323 of the slip assemblies 321 with respect to the longitudinal axis may be at about 18 degrees, and the angle of the tapered inner wall 311 of the bowl 303 with respect to the longitudinal axis may be at about 17 degrees. In such an embodiment, when the tapered inner surface 323 of the slip assemblies 321 is engaging and supporting the tubular member 391B, the slip assemblies 321 may have a downward force applied thereto from the tubular member 391B. As such, to have the tubular member 391B to be able to pass through the apparatus 301, the tubular member 391B must move at an angle of about 18 degrees, as that is the angle of the tapered inner surface 323 of the slip assemblies 321.

However, as the tapered inner wall 311 of the bowl 303 is disposed at an angle of about 17 degrees (less than that of the tapered inner surface 323 of the slip assemblies 321), the slip assemblies 321 may only be able to move at an angle of about 17 degrees to slide against the inner wall 311. As such, this difference of angles between the tapered inner surface 323 of the slip assemblies 321 and the inner wall 311 may prevent the slip assemblies 321 from being able to move upwards (e.g., be actuated upwards) along the longitudinal axis of the bowl 303. Thus, unless an upward force is applied to the tubular member 391B to move the tubular member 391B longitudinally upward along the longitudinal axis of the bowl 303, the slip assemblies 323 may be locked into engagement with the bowl 303 to prevent movement of the slip assemblies 323 with respect to the bowl 303. In this embodiment, one advantage that may be provided would be the mechanical lock, as previously discussed above. As such, with the lock, the slip assemblies may be prevented from releasing the tubular member, unless the tubular member is moved with respect to the slip assemblies, such as by applying a lifting force to the tubular member with respect to the slip assemblies.

Referring still to FIGS. 3A-3D, one or more of the slip assemblies 321 may include an insert 329. For example, although a slip assemblies may be formed as a monolithic structure, a slip assembly 321 may include an insert 329 connected thereto. In such embodiments, rather than having the tapered inner surfaces 323 (e.g., shoulder) formed on the slip assemblies 321, the tapered inner surfaces 323 may instead be formed on the inserts 329. Further, the inserts 329 may be removably connected to the slip assemblies 321, such as through one or more attachment mechanisms (e.g., bolts or screws, as shown). As such, in one or more embodiments, the inserts 329 may be removed from the slip assemblies 321 as desired, such as to replace the inserts 329 when damaged (e.g., wear) and/or to replace the inserts 329 to have a particular size or shape (e.g., for varying sizes and shapes of tubular members).

Figure 4A:
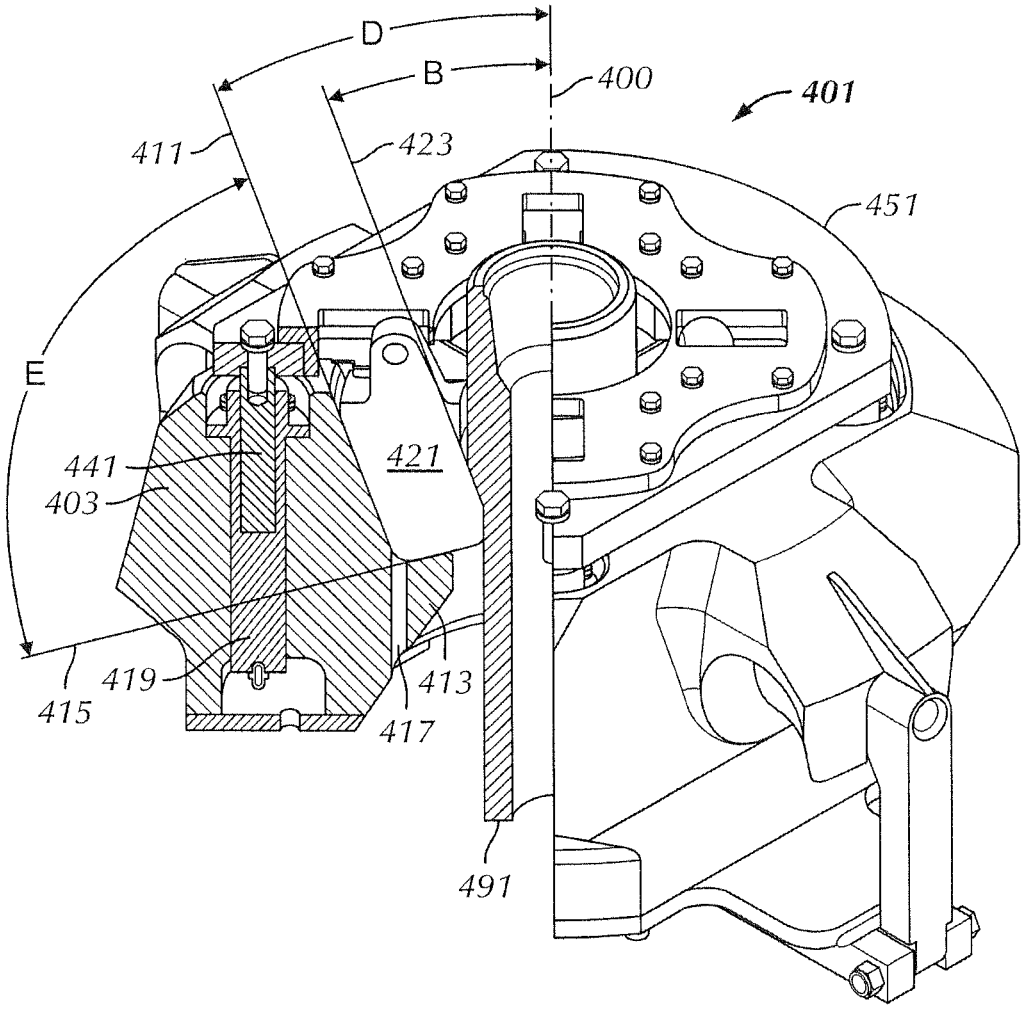
FIGS. 4A-4C show multiple views of an apparatus in accordance with one or more embodiments of the present disclosure.
Figure 4B:
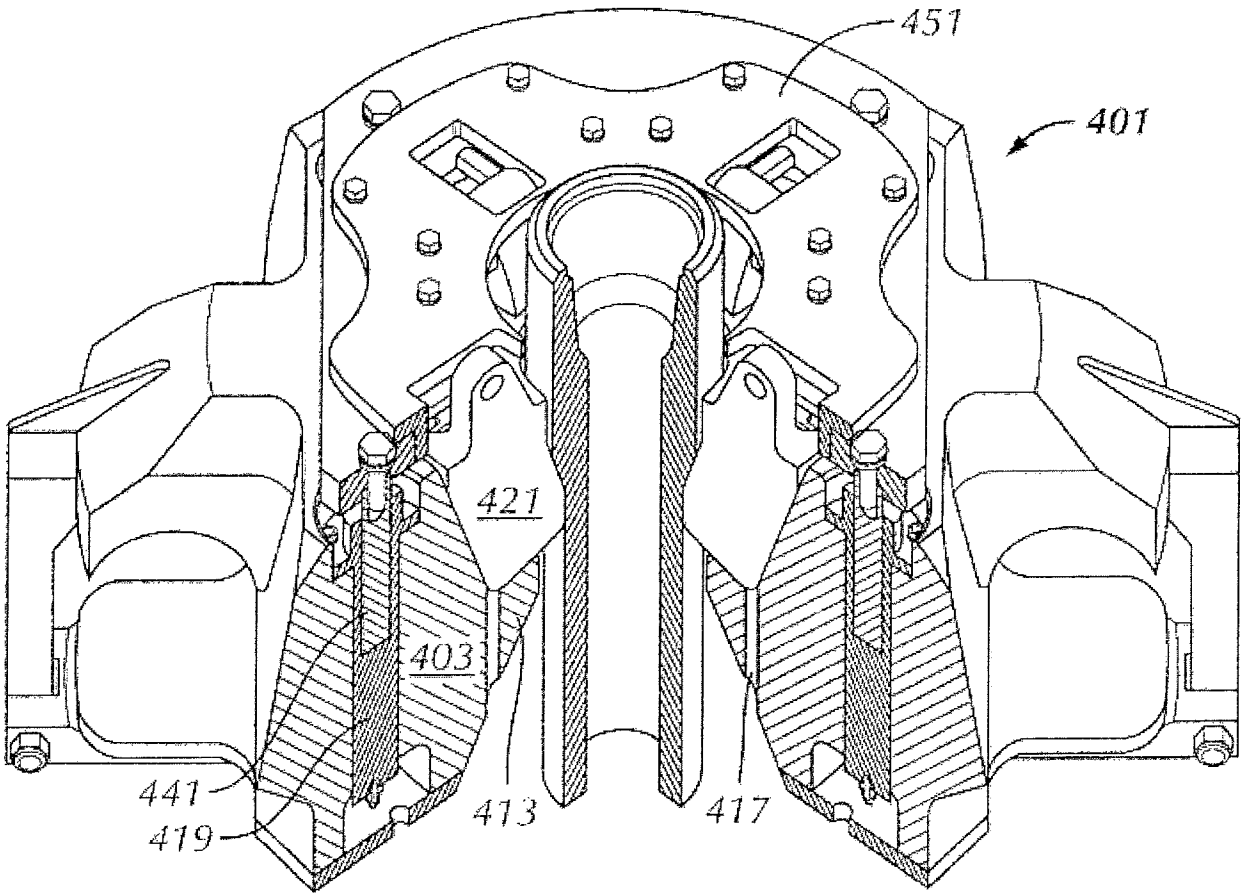
Figure 4C:
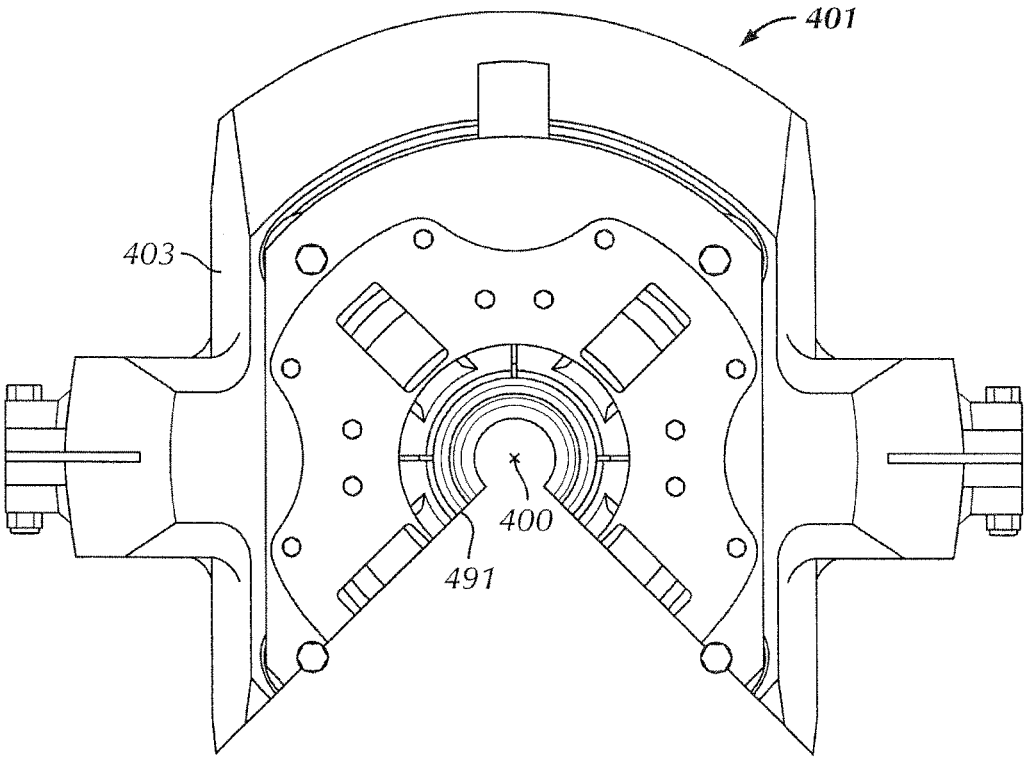

Referring now to FIGS. 4A-4C, multiple views of an apparatus 401 in accordance with one or more embodiments of the present disclosure are shown. Particularly, FIG. 4A shows a perspective cutaway view of the apparatus 401 engaging a tubular member 491, FIG. 4B shows another perspective cutaway view of the apparatus 401 engaging a tubular member 491, and FIG. 4C shows a perspective top cutaway view of the apparatus 401 engaging a tubular member 491.

Similar to the above embodiment in FIG. 3D, the apparatus 401 may include a plurality of slip assemblies 421 having a tapered inner surface disposed at an angle B with respect to the axis 400, and may include a bowl 403 having a tapered inner wall 411 disposed at an angle D with respect to the axis 400. As such, in this embodiment, the angle B of the tapered inner surface 423 of the slip assemblies 421 with respect to the axis 400 may be about 18 degrees, and the angle D of the tapered inner wall 411 of the bowl 403 with respect to the axis 400 may be about 17 degrees.

Further, the apparatus 401 may include a shoulder 413 having an upper surface 415 tapered with respect to the axis 400. Particularly, as shown, the shoulder 413 may have a tapered upper surface 415 disposed at an angle E with respect to the tapered inner wall 411 of the bowl 403. In this embodiment, the angle E of the tapered upper surface 415 of the shoulder 413 may be about 90 degrees. As such, by having the tapered inner wall 411 of the bowl 403 being disposed at an angle D of about 17 degrees with respect to the axis 400, the tapered upper surface 415 of the shoulder 413 may be disposed at about 73 degrees with respect to the axis 400.

Accordingly, in one or more embodiments, the shoulder 413 may have a tapered upper surface 415 disposed at an angle of about 90 degrees with respect to the tapered inner wall 411 of the bowl 403. Such an arrangement may enable the shoulder 413 to extend outward from the inner wall 411 of the bowl 403 and towards the axis 400, thereby enabling the upper surface 415 of the shoulder 413 to support the slip assemblies 421. Those, however, having ordinary skill in the art will appreciate that the present disclosure is not so limited, and other angles and arrangements may be used for the relation between the tapered surfaces of the shoulder and the tapered surfaces of the bowl, in addition to other relations between tapered surfaces.

Further, as shown in FIGS. 4A and 4B particularly, the bowl 403 may have one or more openings 417 formed therein. The bowl 403 may have openings 417 formed therein adjacent to the shoulder 413, such as at an intersection between the tapered inner wall 411 and the shoulder 413, e.g., a trough. The openings 417 may extend through the bowl 403 of the apparatus 401, thereby enabling the openings 417 to provide relief between the engagement of the slip assemblies 421 and the bowl 403. For example, in one or more embodiments, and depending on the taper of the upper surface 415 of the shoulder 413, debris and/or fluid may be able to collect adjacent to the shoulder 413 and interfere with the operation of the slip assemblies 421. As such, by forming an opening 417 to the shoulder, the opening 417 may be able to allow the debris and/or relief pass through the opening 417 and away from the shoulder 413.

Furthermore, as discussed above, the bowl 403 may have one or more cavities formed therein, in which the actuator rods may be able to extend in-and-out of cavities. As such, and as particularly shown in FIGS. 4A and 4B, the bowl 403 may have a plurality of cavities 419 formed therein. The actuator rods 441 may be able to move-in the longitudinal direction along the axis 400, such as by having the actuator rods 441 extend in-and-out of cavities 419 formed within the bowl 403. These cavities 419 may be able to retain the actuator rods 441 within the bowl 403 after the actuator rods 441 have moved longitudinally downward along the axis 400. Furthermore, when the support ring 451 may move in the longitudinal direction along the axis 400, the ring 451 may be powered hydraulically, pneumatically, and/or electrically. As such, in selected embodiments, when using hydraulic power, fluids may be pumped into and/or out of the cavities 419 to move the actuator rods 441 and the support ring 451 downward and/or upward.

Figure 5A:
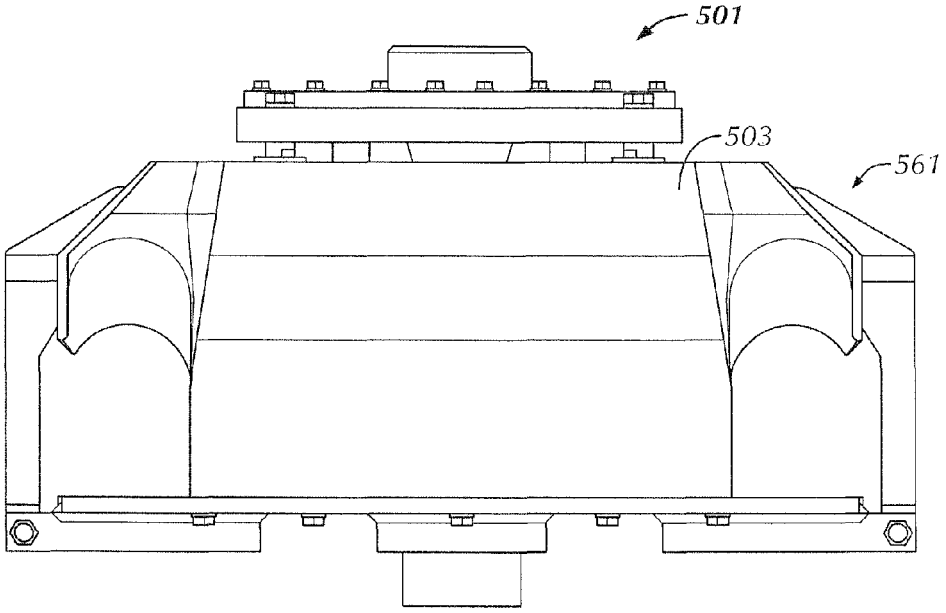
FIGS. 5A-5C show multiple views of an apparatus in accordance with one or more embodiments of the present disclosure.
Figure 5B:
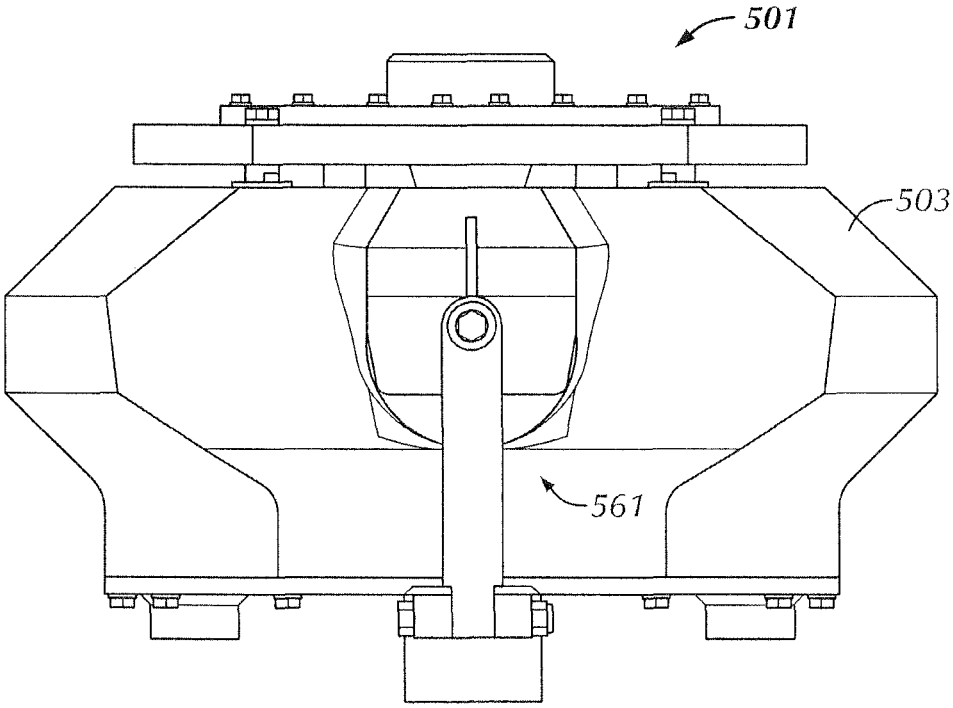
Figure 5C:
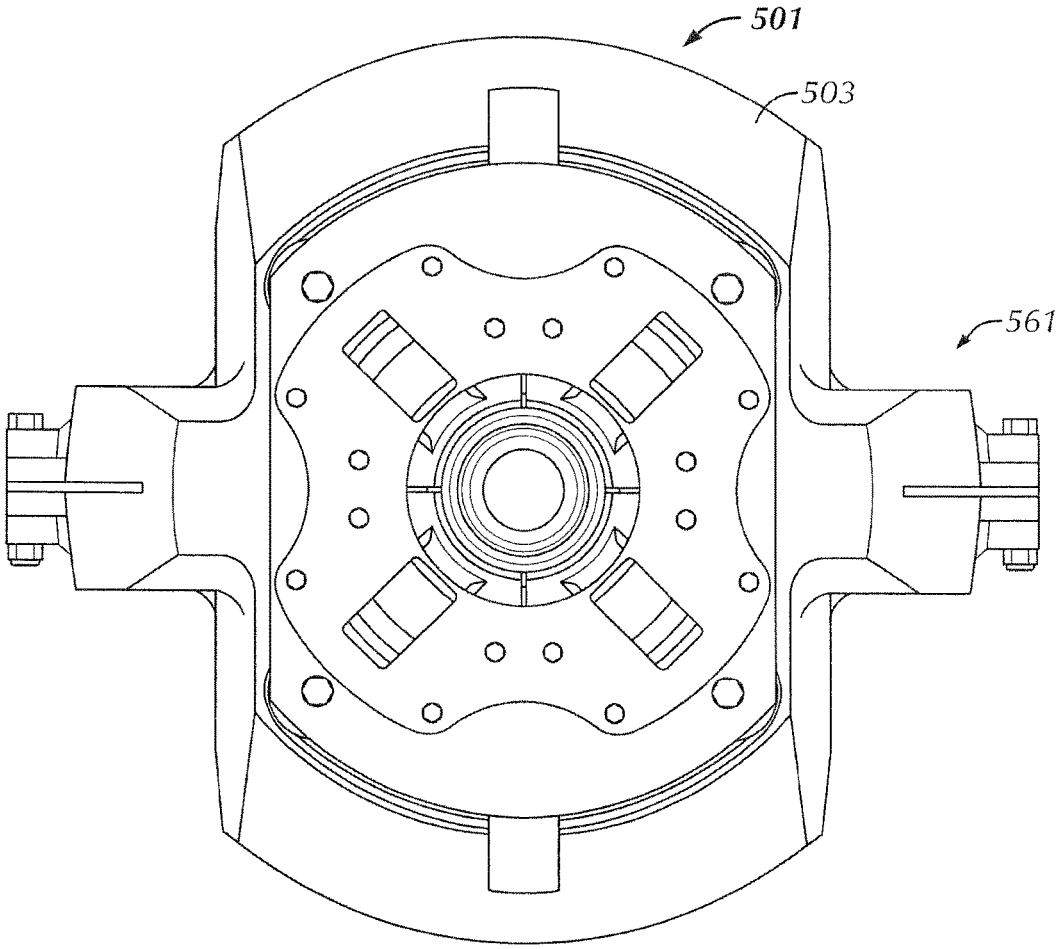

Referring now to FIGS. 5A-5C, multiple views of an apparatus 501 in accordance with one or more embodiments of the present disclosure are shown. Particularly, FIG. 5A shows a perspective side view of the apparatus 501, FIG. 5B shows another perspective side view of the apparatus 501, and FIG. 5C shows a perspective top view of the apparatus 501.

As shown in FIGS. 5A-5C, the apparatus 501 may include one or more support structures 561 (shown as link (e.g., bail) ears) disposed thereon. Particularly, as shown in FIGS. 5A-5C, the apparatus 501 includes two support structures 561, each disposed opposite each other on each side of the apparatus 501. As such, when handling the apparatus 501, such as when in use as an elevator, the support structures 561 may be used as areas to conveniently and/or safely grasp the apparatus 501. For example, link(s) (e.g., bail(s)), line or cable, or some other component of a drilling rig, may be attached to each of the support structures 561, thereby enabling the drilling rig to move the apparatus 501 as desired. Further, those having ordinary skill in the art will appreciate that though one or more support structures may be used within the shown apparatus, the present disclosure is not so limited, as other arrangements and structures are contemplated to support the disclosed apparatus. Furthermore, those having ordinary skill in the art will appreciate that though support structures may be included within the shown apparatus, the apparatus may not have a support structure included at all. For example, in one or more embodiments, in which the apparatus may be used as a support apparatus (e.g., spider), the apparatus may not include a support structure.

Further, as shown, the bowl 503 of the apparatus 501 may be formed as a substantially monolithic structure. For example, the bowl 503 of the apparatus 501 may be formed from a monolithic piece of a material, such as from a single piece of metal. Such an embodiment may provide for an overall increase in strength for the apparatus 501. However, those having ordinary skill in the art will appreciate that the present disclosure is not so limited, as the bowl of the apparatus, in addition to other components of the apparatus, may be formed from one or more sections.

It should be understood that the present disclosure contemplates one or more methods for the use of the apparatus of the present disclosure. For example, the present disclosure may be used to support a tubular member, such as when assembling a string of tubular members together, using the apparatus. Further, the present disclosure also contemplates a method to manufacture an apparatus used to support a tubular member.

Further, it should be understood that the present disclosure contemplates using an apparatus in accordance with embodiments disclosed herein within one, or multiple, drilling rigs. For example, embodiments disclosed herein provide an apparatus that may be used to support a tubular member when in a drilling rig. When assembling a string of tubular members to each other, such as within a drilling rig, the apparatus may be used to support the string of tubular members.

As such, referring now to FIGS. 6A-6D, multiple cross-sectional views of an apparatus 601 engaging and supporting a tubular member 691 in accordance with one or more embodiments of the present disclosure are shown. Particularly, FIGS. 6A-6D show one method to use the apparatus 601, in which the apparatus 601 may be used to support the tubular member 691.

Figure 6A:
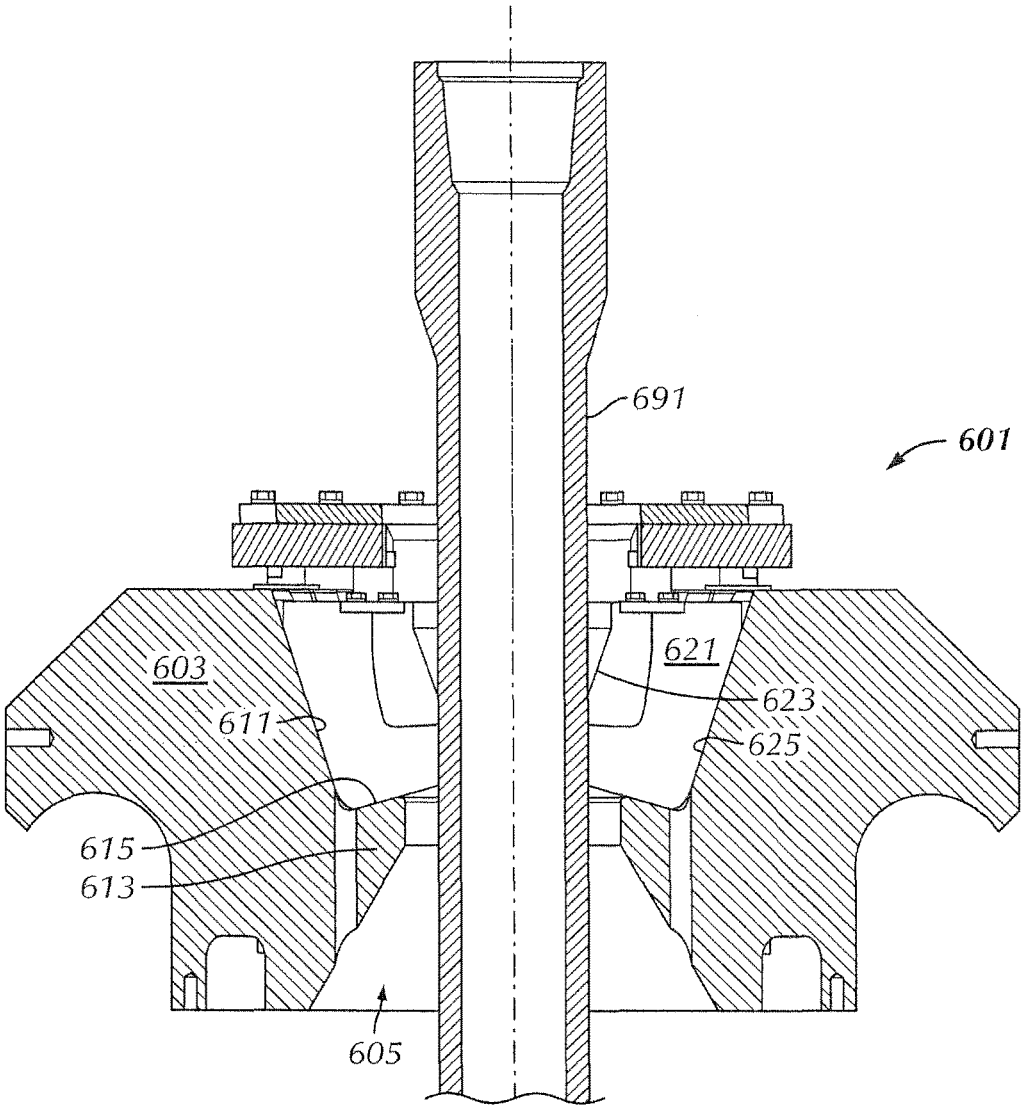
FIGS. 6A-6D show multiple cross-sectional views of an apparatus engaging and supporting a tubular member in accordance with one or more embodiments of the present disclosure.

In FIG. 6A, the tubular member 691 is shown being disposed into the apparatus 601, in which a lower end of the tubular member 691 may be disposed into a bore 605 of the apparatus 601. As the tubular member 691 is disposed within the apparatus 601, such as by having the tubular member 691 lowered with respect to the apparatus 601, the outer surface of the tubular member 691 may be engaged with an inner surface 623 of one or more of the plurality of slip assemblies 621.

Figure 6B:
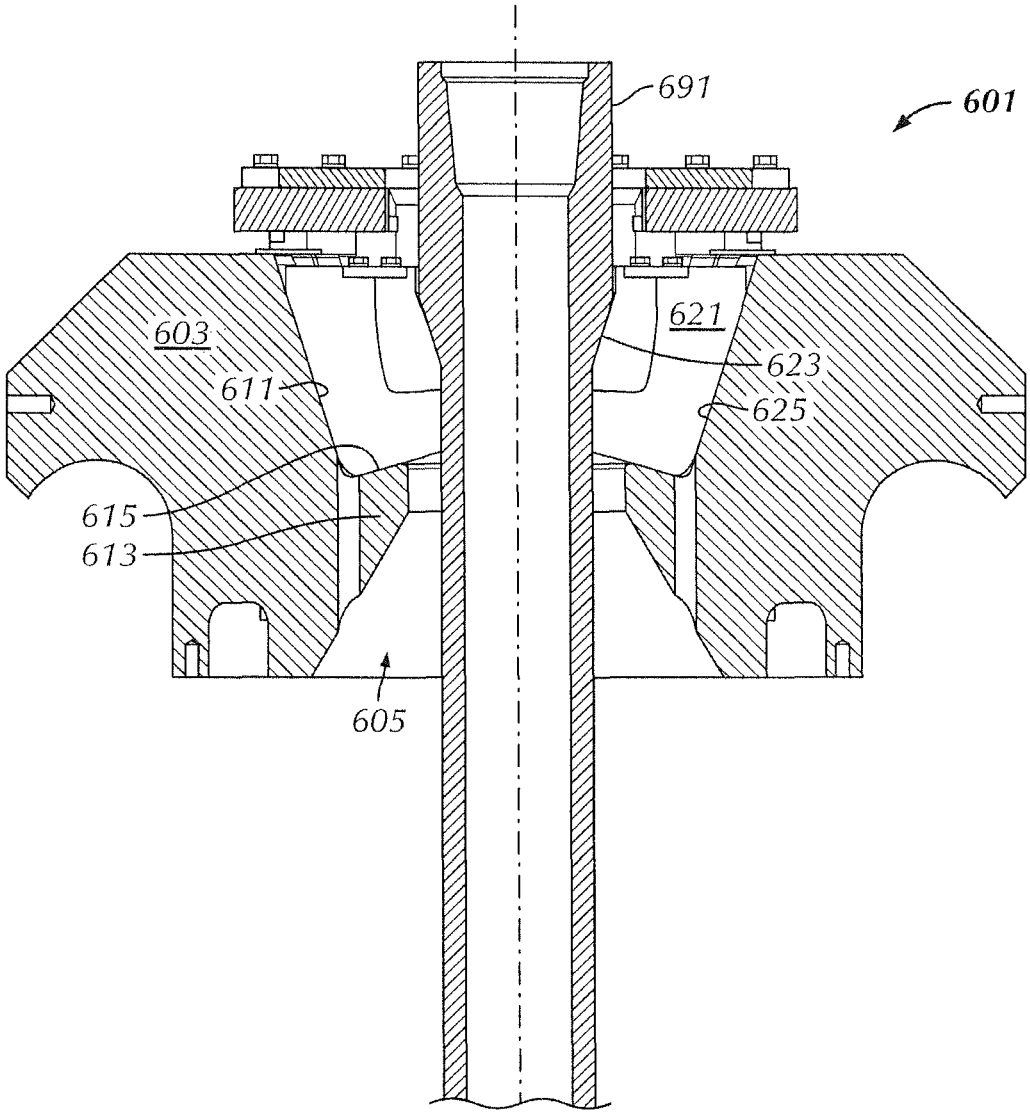

In FIG. 6B, the apparatus 601 is shown as engaged with the tubular member 691, in which the outer surface of the tubular member 691 is engaged by the inner surface 623 of slip assemblies 621, an outer surface 625 of the slip assemblies 621 is engaged by an inner wall 611 of the bowl 603, and/or an upper surface 615 of the shoulder 613 may be engaged with the slip assemblies 621. In such a position, the apparatus 601 may be moved, such as moved within a drilling rig, in which the apparatus 601 may support the tubular member 691 as the apparatus 601 may be raised and/or lowered within the drilling rig.

Figure 6C:
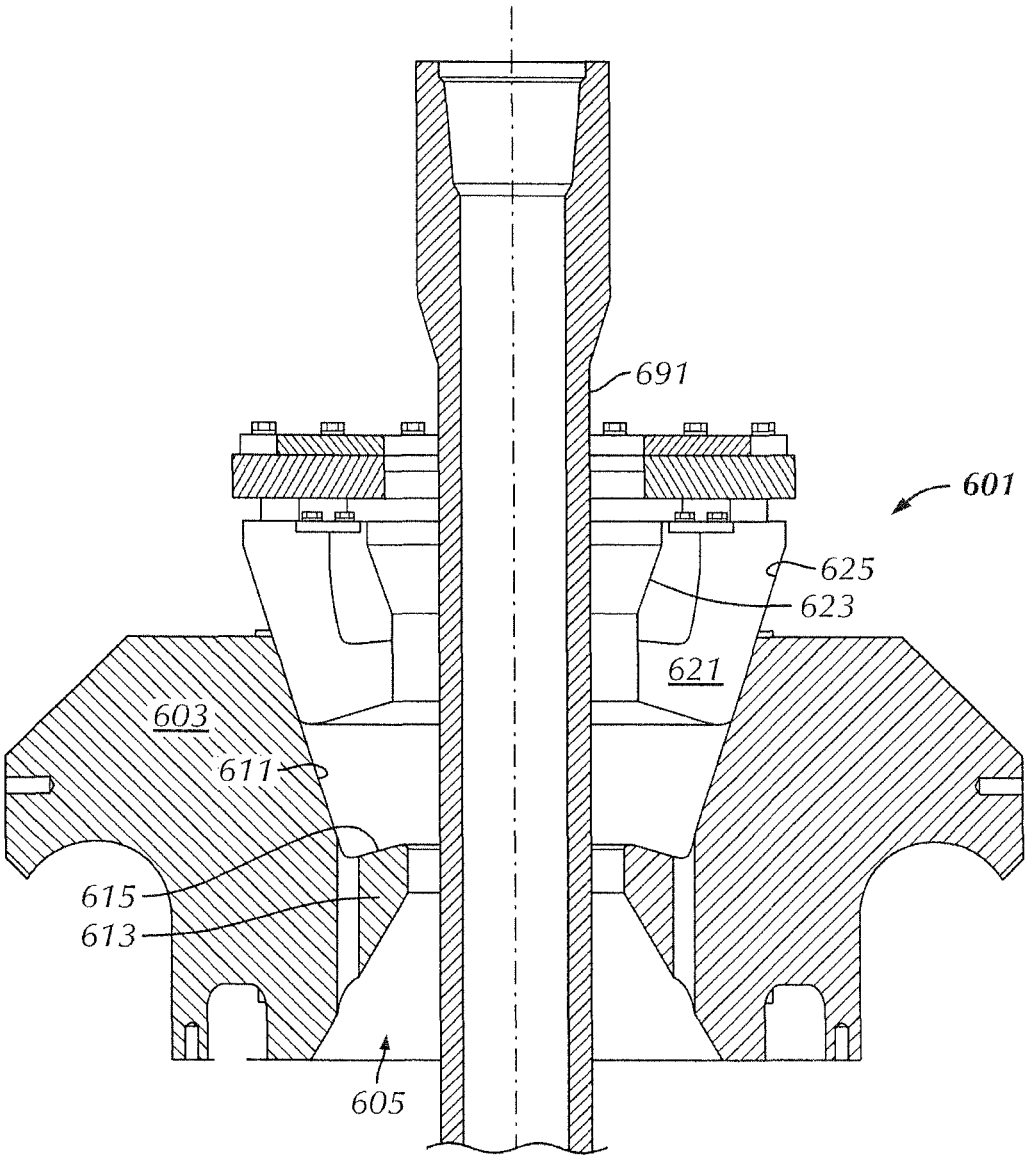

Proceeding to FIG. 6C, the tubular member 691 may be disengaged from the apparatus 601, such as by having the tubular member 691 raised with respect to the apparatus 601 (e.g., bowl 603 thereof). As previously discussed, the slip assemblies 621 and the bowl 603 may have a mechanical lock formed therebetween, such as from the arrangement of the tapered surfaces of the slip assemblies 621 and the bowl 603 and when the shoulder 613 is engaged with the slip assemblies 621. As such, the tubular member 691 may be raised with respect to the bowl 603 of the apparatus 601, in which the tubular member 691 may disengage with the slip assemblies 621 of the apparatus 601. For example, while in a drilling rig, the tubular member 691 may be gripped and supported by a supporting apparatus (e.g., a spider) at the rig floor and/or a top drive. As such, the apparatus 601 may be lowered with respect to the tubular member 691, thereby disengaging the tubular member 691 from the slip assemblies 621.

Figure 6D:
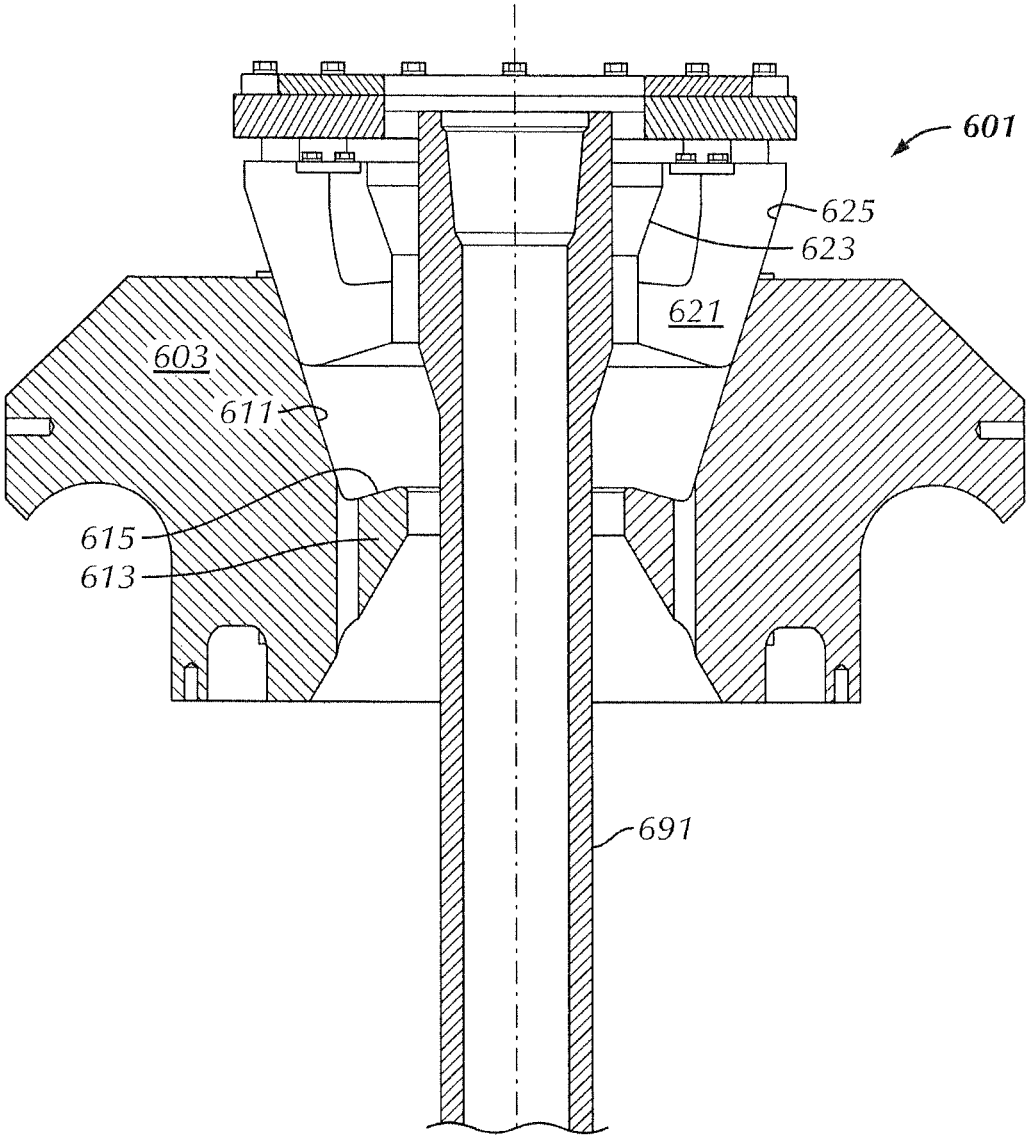

When the tubular member 691 is removed from adjacent the slip assemblies 621, the slip assemblies 621 may then move longitudinally upwards along the axis with respect to the bowl 603 and may move radially outwards from the axis with respect to the bowl 603. Such movement of the slip assemblies 621 may enable the slip assemblies 621 to disengage from the tubular member 691. Further, such movement of the slip assemblies 621 may enable a passage to form through the bore 605 of the bowl 603, such as by having the slip assemblies 621 be able to move back far enough from the axis 600, thereby enabling the tubular member 691 to pass through the apparatus 601. As such, the tubular member 691 may pass through the bore 605 of the apparatus 601, as shown in FIG. 6D, in which the apparatus 601 may then be used to support another tubular member. Such a method may be used when assembling one or more tubular members together, such as to form a string of tubular members. A reverse process, or one substantially similar thereto, may be used when disassembling one or more tubular members from each other. Further, in alternative, rather than disposing the tubular member 691 into the apparatus 601 from above the apparatus 601, as shown in FIG. 6A, the tubular member 691 may be disposed into the apparatus 601 from below, such as shown in an arrangement similar to that in FIG. 6D.

Embodiments disclosed herein may provide for one or more of the following advantages. First, embodiments disclosed herein may provide for an apparatus that may be used to support a tubular member, such as a tubular member within and/or adjacent to a drilling rig. Further, embodiments disclosed herein may provide for an apparatus that may be used to support a tubular member and/or a string of tubular members. In such embodiments, the apparatus may have sufficient strong and/or reliability so as to be able to support the tubular member and/or the string of tubular members, such as within a drilling rig.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the invention should be limited only by the attached claims.

What is claimed is:

1. An apparatus to support a tubular member, the apparatus comprising:

a bowl having a longitudinal axis extending there through, the bowl comprising:

a first opening formed at a top side of the bowl;

a second opening formed at a bottom side of the bowl;

an inner wall extending from the first opening to the second opening about the longitudinal axis, wherein the inner wall is tapered with respect to the longitudinal axis; and a shoulder formed on the inner wall extending toward the longitudinal axis with respect to the inner wall, wherein a top surface of the shoulder is angled upwardly in a radially inward direction with respect to the longitudinal axis; and a plurality of slip assemblies movably disposed within to the bowl and having a tapered outer surface and a tapered inner surface with respect to the longitudinal axis; and wherein the tapered outer surface of the plurality of slip assemblies is configured to engage the tapered inner wall of the bowl, and wherein an angle of the tapered inner surface of the plurality of slip assemblies with respect to the longitudinal axis and an angle of the tapered inner wall of the bowl with respect to the longitudinal axis form a mechanical lock.

2. The apparatus of claim 1, wherein the angle of the tapered inner surface of the plurality of slip assemblies with respect to the longitudinal axis is larger than the angle of the tapered inner wall of the bowl with respect to the longitudinal axis.

3. The apparatus of claim 1, wherein a bottom surface of the plurality of slip assemblies is configured to engage the top surface of the shoulder of the bowl.

4. The apparatus of claim 1, further comprising a support ring disposed adjacent to the top side of the bowl, wherein at least one of the plurality of slip assemblies is connected to the support ring.

5. The apparatus of claim 4, further comprising actuator rods for actuating the support ring, wherein a plurality of cavities are formed on the bowl which enable the actuator rods to extend in and out, which enables a longitudinal movement of the support ring.

6. The apparatus of claim 4, wherein the support ring comprises a timing ring configured to move in a longitudinal direction along the longitudinal axis with respect to the bowl.

7. The apparatus of claim 6, wherein at least one of the plurality of slip assemblies is movably connected to the timing ring such that the at least one of the plurality of slip assemblies is configured to move in a radial direction of the longitudinal axis with respect to the bowl.

8. The apparatus of claim 1, wherein at least one of the plurality of slip assemblies comprises an insert, wherein the tapered inner surface of the at least one of the plurality of slip assemblies is formed on the insert.

9. An apparatus to support a tubular member, the apparatus comprising:

a bowl having a longitudinal axis extending therethrough, the bowl comprising:

a first opening formed at a top side of the bowl;

a second opening formed at a bottom side of the bowl;

an inner wall extending from the first opening to the second opening about the longitudinal axis, wherein the inner wall is tapered with respect to the longitudinal axis; and a shoulder disposed on the inner wall that extends towards the longitudinal axis with respect to the inner wall, wherein a top surface of the shoulder is angled upwardly in a radially inward direction with respect to the longitudinal axis; and a plurality of slip assemblies movably disposed within the bowl and having a tapered inner surface with respect to the longitudinal axis, wherein each of the plurality of slip assemblies is configured to engage the shoulder of the bowl.

10. The apparatus of claim 9, wherein an angle of the tapered inner surface of the plurality of slip assemblies with respect to the longitudinal axis and an angle of the tapered inner wall of the bowl with respect to the longitudinal axis form a mechanical lock.

11. The apparatus of claim 10, wherein the angle of the tapered inner surface of the plurality of slip assemblies with respect to the longitudinal axis is larger than the angle of the tapered inner wall of the bowl with respect to the longitudinal axis.

12. The apparatus of claim 9, wherein a bottom surface of the plurality of slip assemblies is configured to engage the top surface of the shoulder of the bowl.

13. The apparatus of claim 9, further comprising a support ring disposed adjacent to the top side of the bowl, wherein at least one of the plurality of slip assemblies is connected to the support ring.

14. The apparatus of claim 13, further comprising actuator rods for actuating the support ring, wherein a plurality of cavities are formed on the bowl which enable the actuator rods to extend in and out, which enables a longitudinal movement of the support ring.

15. The apparatus of claim 9, wherein at least one opening is formed within the bowl and adjacent to the shoulder of the bowl.

16. A method to manufacture an apparatus to support a tubular member, the method comprising:

providing a bowl having an inner wall formed therein and extending therethrough, wherein the bowl and the inner wall are defined about a longitudinal axis, and wherein the inner wall is tapered with respect to the longitudinal axis, and a shoulder formed on the inner wall extending toward the longitudinal axis with respect to the inner wall, wherein a top surface of the shoulder is angled upwardly in a radially inward direction with respect to the longitudinal axis;

movably coupling a plurality of slip assemblies to the bowl, wherein the plurality of slip assemblies has a tapered outer surface and a tapered inner surface with respect to the longitudinal axis; and forming a mechanical lock between an angle of the tapered inner surface of the plurality of slip assemblies with respect to the longitudinal axis and an angle of the tapered inner wall of the bowl with respect to the longitudinal axis.

17. The method of claim 16, wherein the angle of the tapered inner surface of the plurality of slip assemblies with respect to the longitudinal axis is larger than the angle of the tapered inner wall of the bowl with respect to the longitudinal axis.

18. The method of claim 16, wherein a bottom surface of the plurality of slip assemblies is configured to engage the top surface of the shoulder of the bowl.

19. The method of claim 16, further comprising a support ring disposed adjacent to the top side of the bowl, wherein at least one of the plurality of slip assemblies is connected to the support ring.

20. The method of claim 19, further comprising actuator rods for actuating the support ring, wherein a plurality of cavities are formed on the bowl which enable the actuator rods to extend in and out, which enables a longitudinal movement of the support ring.

21. The method of claim 19, wherein at least one of the plurality of slip assemblies comprises an insert, wherein the tapered inner surface of the at least one of the plurality of slip assemblies is formed on the insert.

22. A method to manufacture an apparatus to support a tubular member, the method comprising:

providing a bowl having an inner wall formed therein and extending therethrough, wherein the bowl and the inner wall are defined about a longitudinal axis, and wherein a shoulder is disposed on the inner wall that extends towards the longitudinal axis with respect to the inner wall, wherein a top surface of the shoulder is angled upwardly in a radially inward direction with respect to the longitudinal axis;

movably coupling a plurality of slip assemblies to the bowl, wherein the plurality of slip assemblies has a tapered inner surface with respect to the longitudinal axis.

23. The method of claim 22, further comprising forming a mechanical lock between an angle of the tapered inner surface of the plurality of slip assemblies with respect to the longitudinal axis and an angle of the tapered inner wall of the bowl with respect to the longitudinal axis.

24. The method of claim 22, wherein the angle of the tapered inner surface of the plurality of slip assemblies with respect to the longitudinal axis is larger than the angle of the tapered inner wall of the bowl with respect to the longitudinal axis.

25. The method of claim 22, wherein a bottom surface of the plurality of slip assemblies is configured to engage the top surface of the shoulder of the bowl.

26. The method of claim 22, further comprising a support ring disposed adjacent to the top side of the bowl, wherein at least one of the plurality of slip assemblies is connected to the support ring.

27. The method of claim 26, further comprising actuator rods for actuating the support ring, wherein a plurality of cavities are formed on the bowl which enable the actuator rods to extend in and out, which enables a longitudinal movement of the support ring.

28. A method to support a tubular member, the method comprising:

providing a bowl having an inner wall extending therethrough and a plurality of slip assemblies movably connected thereto, wherein the bowl and the inner wall are defined about a longitudinal axis, and a shoulder formed on the inner wall extending toward the longitudinal axis with respect to the inner wall, wherein a top surface of the shoulder is angled upwardly in a radially inward direction with respect to the longitudinal axis;

disposing the tubular member within the bore of the bowl;

engaging an outer tapered surface of the tubular member with an inner surface of the plurality of slip assemblies, wherein the inner surface of the plurality of slip assemblies is tapered with respect to the longitudinal axis; and engaging an outer surface of the plurality of slip assemblies with the inner wall of the bowl, wherein the outer surface of the plurality of slip assemblies and the inner wall are tapered with respect to the longitudinal axis.

29. The method of claim 28, wherein an angle of the tapered inner surface of the plurality of slip assemblies with respect to the longitudinal axis and an angle of the tapered inner wall of the bowl with respect to the longitudinal axis form a mechanical lock.

30. The method of claim 28, further comprising at least one of:

raising the bowl within a drilling rig with respect to the drilling rig while the outer surface of the tubular member is engaged with the inner surface of the plurality of slip assemblies to raise the tubular member with the bowl; and lowering the bowl within the drilling rig with respect to the drilling rig while the outer surface of the tubular member is engaged with the inner surface of the plurality of slip assemblies to lower the tubular member with the bowl.

31. The method of claim 28, further comprising:

raising the tubular member along the longitudinal axis relative to the bowl, thereby disengaging the outer surface of the tubular member from the inner surface of the plurality of slip assemblies;

moving the plurality of slip assemblies upward with respect to the bowl, thereby disengaging the outer surface of the plurality of slip assemblies from the inner wall of the bowl; and lowering the tubular member along the longitudinal axis through the bowl.

32. A method to support a tubular member, the method comprising:

providing a bowl having an inner wall extending therethrough and a plurality of slip assemblies movably connected thereto, wherein the bowl and the inner wall are defined about a longitudinal axis, and wherein the inner wall of the bowl is tapered with respect to the longitudinal axis;

disposing the tubular member within the bore of the bowl;

engaging an outer tapered surface of the tubular member with an inner surface of the plurality of slip assemblies, wherein the inner surface of the plurality of slip assemblies is tapered with respect to the longitudinal axis; and engaging the plurality of slip assemblies with a shoulder disposed on the inner wall of the bowl, wherein the shoulder extends towards the longitudinal axis with respect to the inner wall, and wherein a top surface of the shoulder is angled upwardly in a radially inward direction with respect to the longitudinal axis.

33. The method of claim 32, wherein an angle of the tapered inner surface of the plurality of slip assemblies with respect to the longitudinal axis and an angle of the tapered inner wall of the bowl with respect to the longitudinal axis form a mechanical lock.

34. The method of claim 32, further comprising:

raising the tubular member along the longitudinal axis with respect to the bowl, thereby disengaging the outer surface of the tubular member from the inner surface of the plurality of slip assemblies;

longitudinally moving a plurality of slip assemblies upward along the longitudinal axis with respect to the bowl, thereby disengaging each of the plurality of slip assemblies from the shoulder of the bowl;

radially moving a plurality of slip assemblies outward from the longitudinal axis with respect to the bowl; and lowering the tubular member along the longitudinal axis through the bowl.

* * * * *